US012317964B2

(12) United States Patent
Chen

(10) Patent No.: US 12,317,964 B2
(45) Date of Patent: Jun. 3, 2025

(54) FASTENING DEVICE

(71) Applicant: Chin-Chu Chen, Taichung (TW)

(72) Inventor: Chin-Chu Chen, Taichung (TW)

( * ) Notice: Subject to any disclaimer, the term of this patent is extended or adjusted under 35 U.S.C. 154(b) by 0 days.

(21) Appl. No.: 18/371,451

(22) Filed: Sep. 22, 2023

(65) Prior Publication Data

US 2024/0008598 A1 Jan. 11, 2024

Related U.S. Application Data

(63) Continuation-in-part of application No. 17/650,526, filed on Feb. 10, 2022, now Pat. No. 11,963,585.

(30) Foreign Application Priority Data

Mar. 31, 2021 (TW) ..... 110111715

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43B 9/16; A43B 13/04; A43B 23/042; A43B 5/007; A43B 5/049; A43B 1/04
See application file for complete search history.

(56) References Cited

U.S. PATENT DOCUMENTS

| | | | | |
|---|---|---|---|---|
| 10,413,019 | B2 * | 9/2019 | Soderberg | A43C 11/165 |
| 10,609,988 | B2 * | 4/2020 | Ha | A43B 3/0078 |
| 10,842,230 | B2 * | 11/2020 | Pollack | A43C 7/00 |
| 11,633,018 | B2 * | 4/2023 | Burt | E05C 3/145 242/395 |
| 2013/0118043 | A1 * | 5/2013 | Favier | G09F 7/06 40/518 |
| 2014/0359981 | A1 | 12/2014 | Cotterman et al. | |
| 2018/0160775 | A1 * | 6/2018 | Pollack | B65H 75/4492 |

FOREIGN PATENT DOCUMENTS

| | | | |
|---|---|---|---|
| CN | 104010543 | A | 8/2014 |
| CN | 207023427 | U | 2/2018 |
| CN | 109315882 | A | 2/2019 |
| JP | S60-170109 | U | 11/1985 |
| JP | 2016520401 | A | 7/2016 |
| JP | 2016530028 | A | 9/2016 |
| KR | 101415495 | B1 | 7/2014 |
| KR | 10-2020-0126596 | A | 11/2020 |
| KR | 102439929 | B1 | 9/2022 |
| TW | 202029901 | A | 8/2020 |

* cited by examiner

*Primary Examiner* — David M Upchurch
(74) *Attorney, Agent, or Firm* — CKC & Partners Co., LLC

(57) ABSTRACT

A fastening device includes a case, a spool disposed within the case, an engaging unit disposed above the spool, and a knob covering the upper case body. The case includes an upper case body including at least one protecting wing extending upward, and a base detachably coupled to the upper case body. At least a portion of the at least one protecting wing is higher than a lower edge of the knob.

8 Claims, 23 Drawing Sheets

140

240

500

FASTENING DEVICE

RELATED APPLICATIONS

This application is a Continuation-in-part of U.S. application Ser. No. 17/650,526, filed Feb. 10, 2022, which claims priority to Taiwan Application Serial Number 110111715, filed Mar. 31, 2021, all of which are herein incorporated by reference.

BACKGROUND

Technical Field

The present disclosure relates to a fastening device. More particularly, the present disclosure relates to a fastening device which is used to be installed on an article and can fasten a lace.

Description of Related Art

In general, a wearable article can include a first side and a second side. The second side is opposite to the first side, and the first side and the second side are closed to tighten the wearable article to a worn part. For example, a shoe can include a shoe tongue which is located between the first side and the second side. The shoe can further include a plurality of eyelets which are arranged at the first side and the second side. In the conventional art, the shoelace can pass through the eyelets, and then be tied so as to fasten the article.

However, the shoelace has to be loosened before taking off the shoes, and then the shoelace has to be tied again when wearing the shoes. Thus, it causes great inconveniences. To solve the aforementioned problem, some practitioners develop a fastening device which can be deposed on the shoe tongue and coupled to a lace, and the lace can pass through the eyelets and replace the shoelace. By operating the fastening device, the lace can be loosened and tightened quickly so as to allow the shoes to be worn or taken off easily.

In the present art, the fastening device is fixed on the shoe tongue during the post-processing of the shoe. In other words, if the shoe is not configured to be an article having a fastening device, the user can hardly couple the fastening device to the shoe. Therefore, some practitioners develop another kind of fastening device which includes a positioning sheet. The positioning sheet includes a plurality of positioning holes so that the lace can pass through the eyelets and the positioning holes, and then be coupled to a reel part of the fastening device. Hence, the fastening device can be coupled to the shoe article. However, when the user loosens the lace, a gap is formed between the positioning sheet and the shoe article. In the result, the shaking occurs on the fastening device so as to cause inconvenience of using. Similarly, the same problem occurs when the fastening device is applied to other wearable articles.

Based on the above-mentioned problems, how to improve the structure of the fastening device to increase the flexibility and stability when installing the fastening device on the article becomes a pursued target of practitioners.

SUMMARY

According to one aspect of the present disclosure, a fastening device is provided. The fastening device includes a case, a spool disposed within the case, an engaging unit disposed above the spool, and a knob covering the upper case body. The case includes an upper case body including at least one protecting wing extending upward, and a base detachably coupled to the upper case body. At least a portion of the at least one protecting wing is higher than a lower edge of the knob.

BRIEF DESCRIPTION OF THE DRAWINGS

The present disclosure can be more fully understood by reading the following detailed description of the embodiment, with reference made to the accompanying drawings as follows.

DETAILED DESCRIPTION

It will be understood that when an element (or mechanism or module) is referred to as being "disposed on", "connected to" or "coupled to" another element, it can be directly disposed on, connected or coupled to the other one element, or it can be indirectly disposed on, connected or coupled to the other one element, that is, intervening elements may be present. In contrast, when an element is referred to as being "directly disposed on", "directly connected to" or "directly coupled to" another element, there are no intervening elements present.

In addition, the terms first, second, third, etc. are used herein to describe various elements or components, these elements or components should not be limited by these terms. Consequently, a first element or component discussed below could be termed a second element or component.

Figure 1:
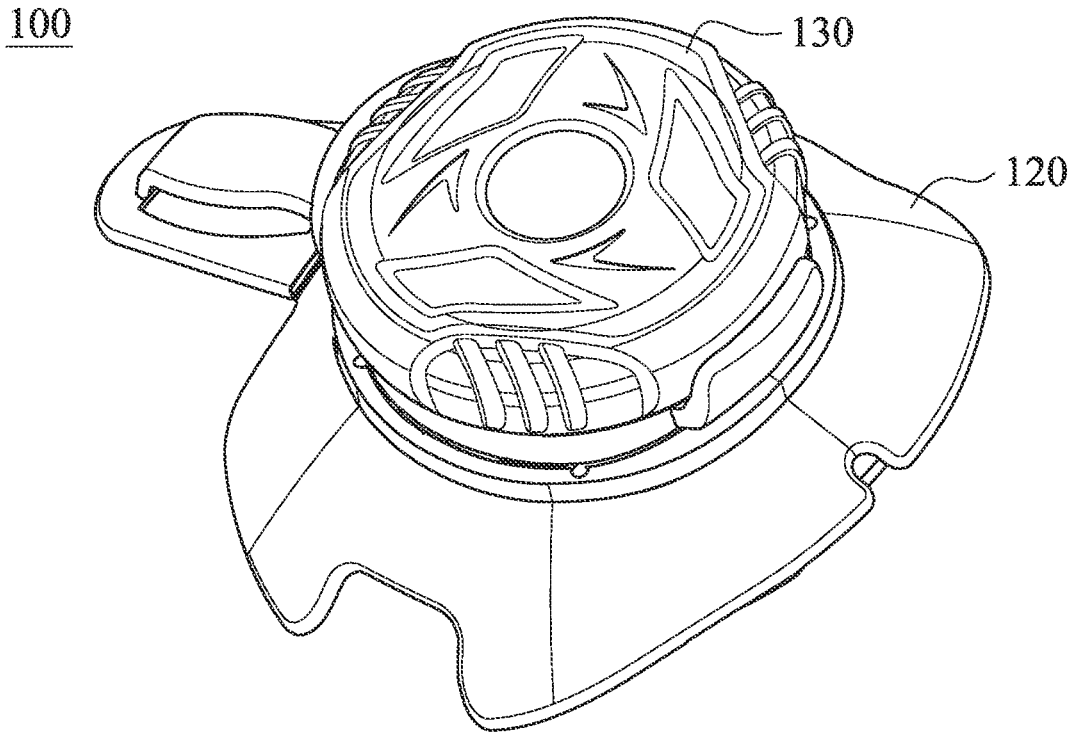
FIG. 1 shows a three-dimensional schematic view of a fastening device according to the 1st embodiment of the present disclosure.
Figure 2:
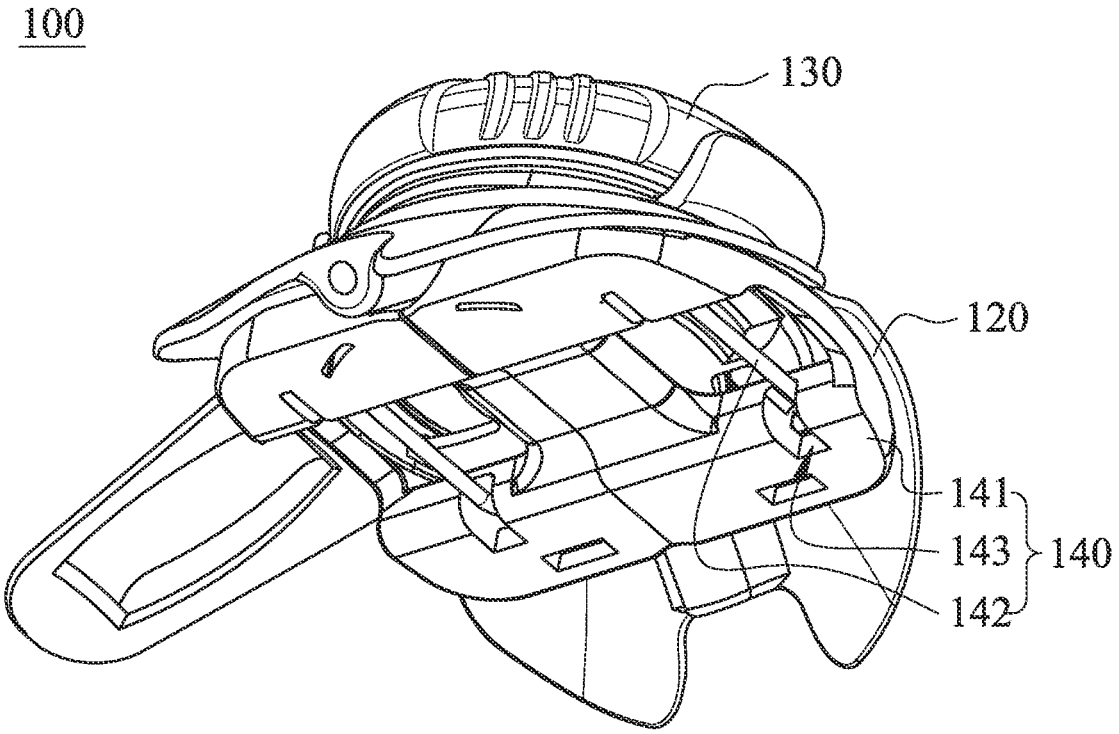
FIG. 2 shows another three-dimensional schematic view of the fastening device of the 1st embodiment in FIG. 1.
Figure 3:
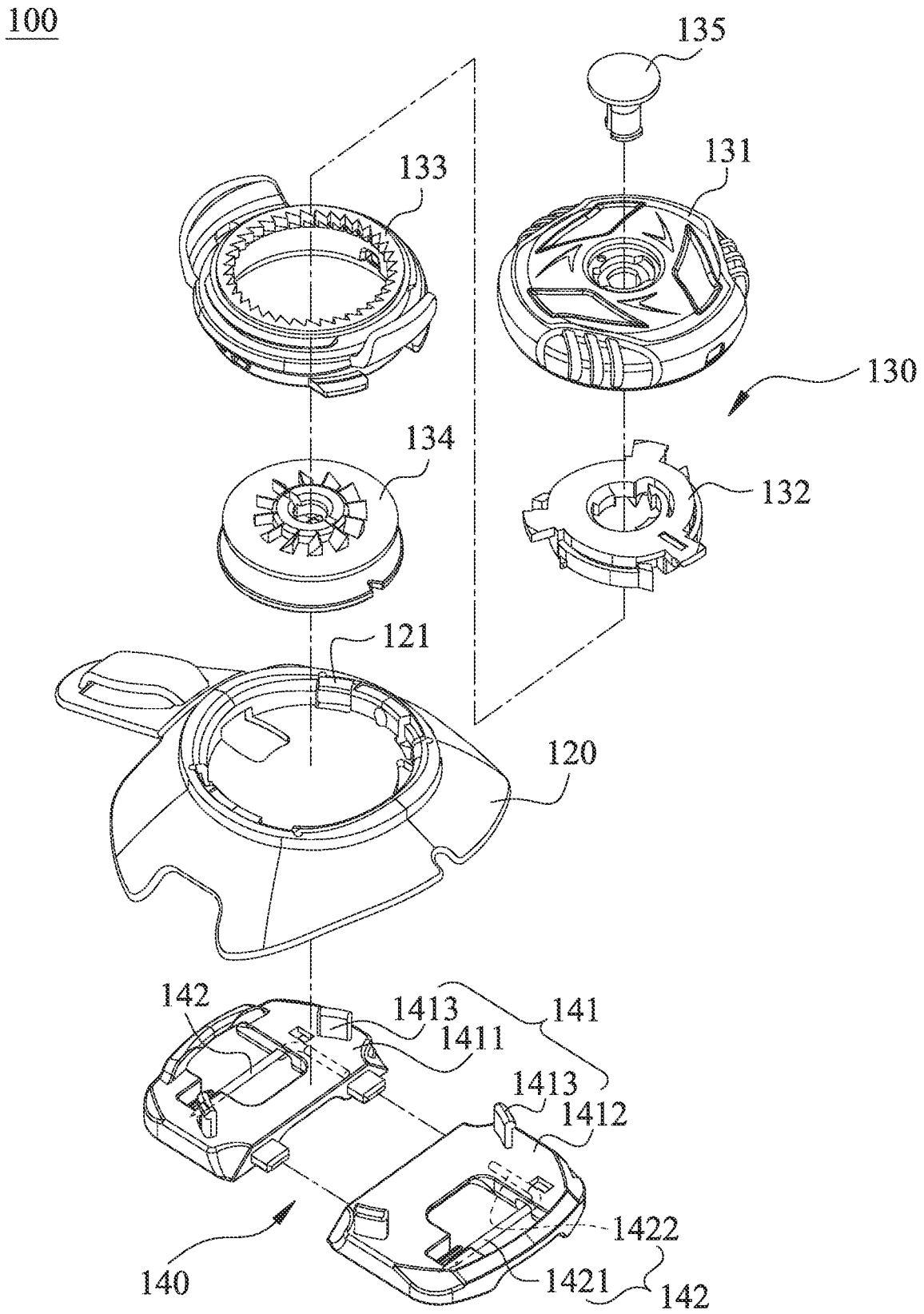
FIG. 3 shows an exploded schematic view of the fastening device of the 1st embodiment in FIG. 1.

Please refer to FIGS. 1, 2 and 3. FIG. 1 shows a three-dimensional schematic view of a fastening device 100 according to the 1st embodiment of the present disclosure. FIG. 2 shows another three-dimensional schematic view of the fastening device 100 of the 1st embodiment in FIG. 1. FIG. 3 shows an exploded schematic view of the fastening device 100 of the 1st embodiment in FIG. 1. The fastening device 100 is configured to be installed on an article S1 (shown in FIG. 7) and includes a base 120, an installing assembly 140 and a reel part 130. The base 120 is located on the article S1, and the installing assembly 140 includes at least one needle 142. The aforementioned at least one needle 142 is disposed at the base 120 so as to rotate relatively to the base 120. The reel part 130 is coupled to a lace and disposed on the base 120. The aforementioned at least one needle 142 is inserted from a first surface S11 (shown in FIG. 7) of the article S1 into a second surface S12 (shown in FIG. 7) of the article S1, then inserted from the second surface S12 of the article S1 into the first surface S11 of the article S1, and the aforementioned at least one needle 142 is restricted to the article S1 for securing the base 120 on the first surface S11 of the article S1.

Hence, the fastening device 100 can be installed and secured on the article S1 via the aforementioned at least one needle 142, and the stability and the flexibility of installing can be improved.

The reel part 130 can include a knob 131, an engaging unit 132, an upper case body 133, a spool 134 and a restricting shaft 135. The spool 134 and the engaging unit 132 are received in the upper case body 133, and the knob 131 covers the upper case body 133. The restricting shaft 135 inserts the knob 131 downwardly so as to be coupled to the spool 134. Therefore, after the fastening device 100 is installed and secured on the article S1 via the aforementioned at least one needle 142, the lace can pass through eyelets (not shown) and be wound on the spool 134, and then the knob 131 can be operated to tighten the lace, thereby tightening the article S1. The upper case body 133 includes two protecting wings extending upward.

Figure 4:
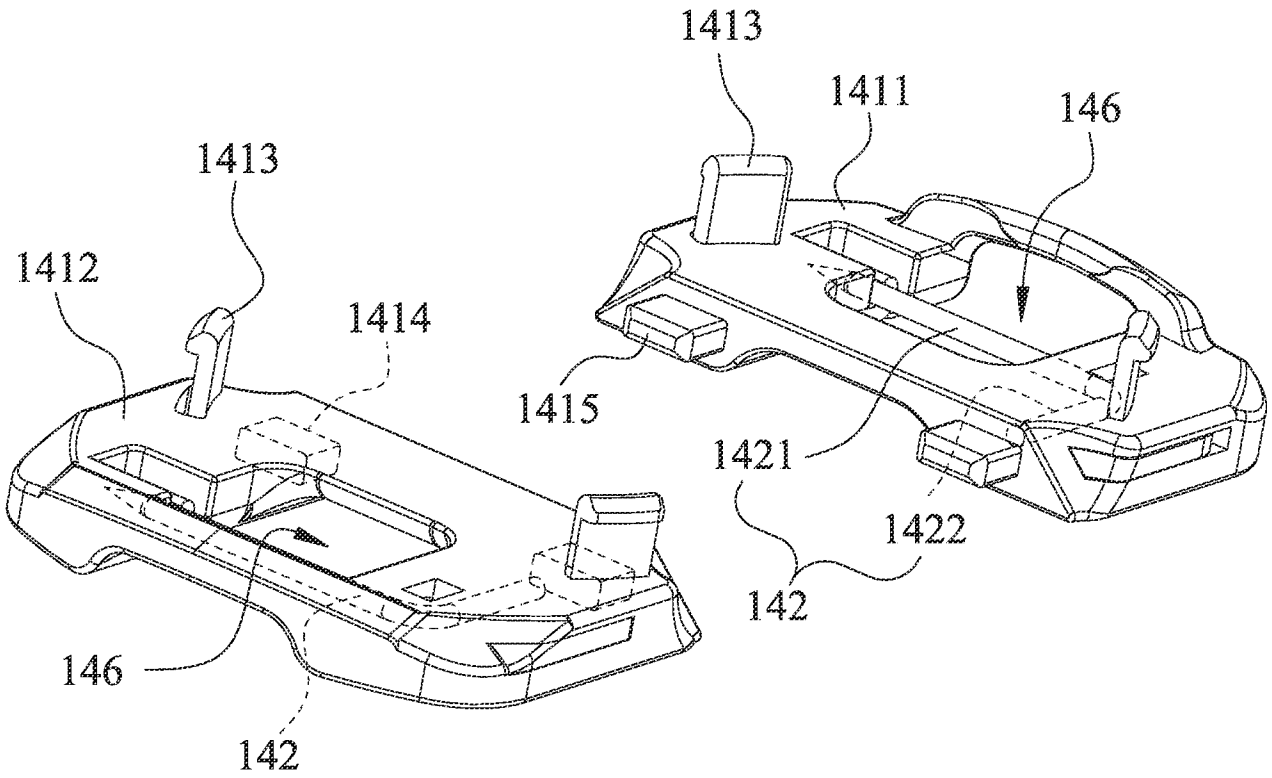
FIG. 4 shows a schematic view of the installing assembly of the fastening device of the 1st embodiment in FIG. 1.
Figure 5:
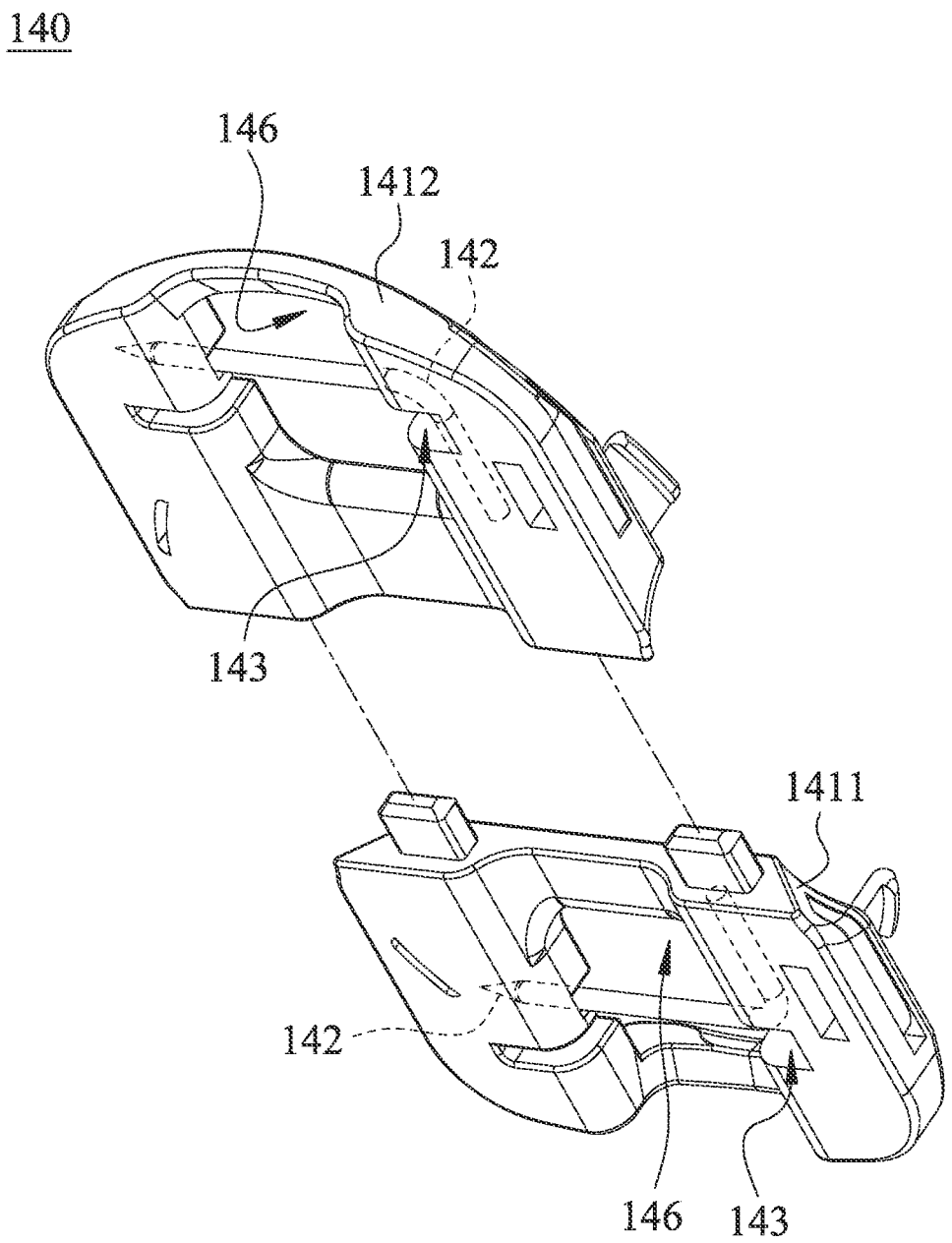
FIG. 5 shows another schematic view of the installing assembly of the fastening device of the 1st embodiment in FIG. 1.
Figure 6:
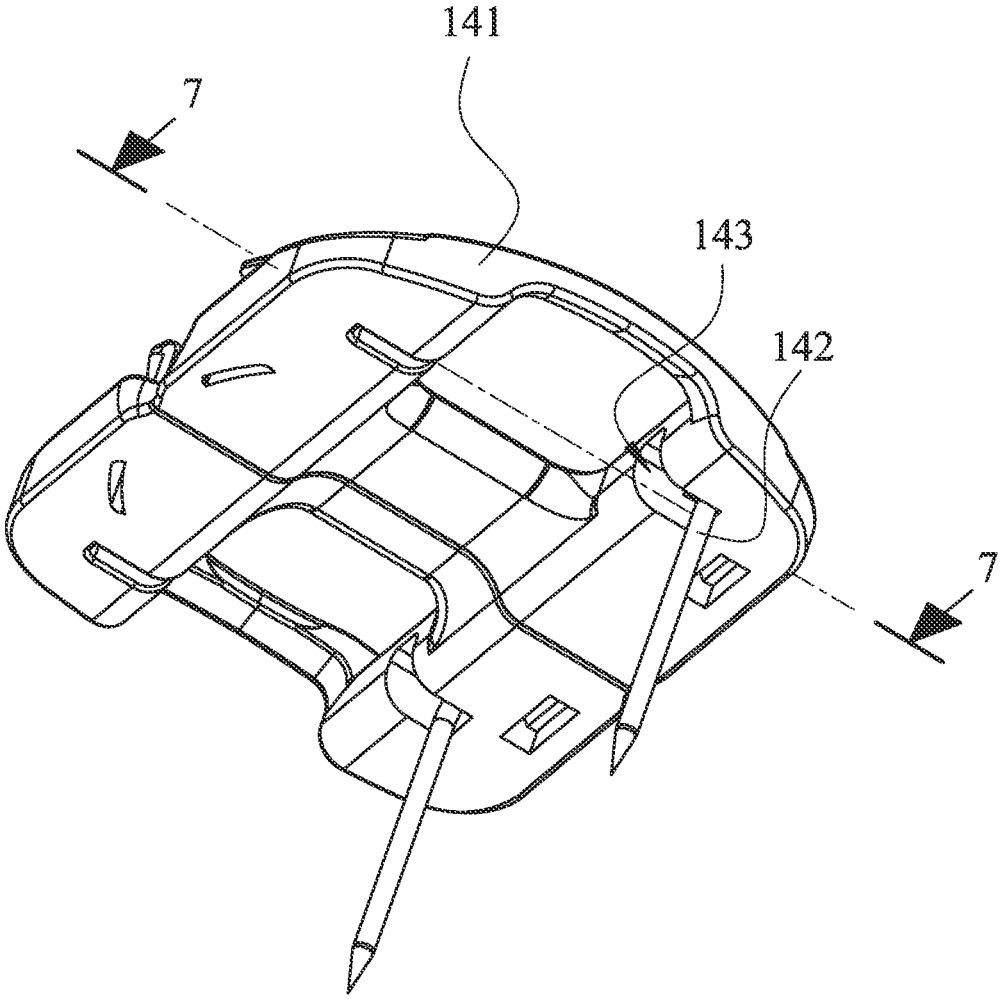
FIG. 6 shows an operation of the installing assembly of the fastening device of the 1st embodiment in FIG. 1.

Please refer to FIGS. 4, 5 and 6. FIG. 4 shows a schematic view of the installing assembly 140 of the fastening device 100 of the 1st embodiment in FIG. 1. FIG. 5 shows another schematic view of the installing assembly 140 of the fastening device 100 of the 1st embodiment in FIG. 1. FIG. 6 shows an operation of the installing assembly 140 of the fastening device 100 of the 1st embodiment in FIG. 1. The installing assembly 140 can further include a base plate 141. The base plate 141 is detachably mounted on the base 120. Because the base plate 141 is detachably mounted on the base 120, the base plate 141 and the at least one needle 142 can be mounted on the base 120 before the reel part 130 is mounted on the base 120 so as to improve easiness of installing.

In detail, the base plate 141 can include a first body 1411 and a second body 1412. The first body 1411 is engaged with the second body 1412. Two latches 1415 can be protruded from the first body 1411, and two inserting grooves 1414 can be recessed on the second body 1412. With each of the latches 1415 inserting into each of the inserting grooves 1414, the first body 1411 can be combined with the second body 1412, but the present disclosure is not limited thereto.

As shown in FIGS. 3 and 4, the base 120 can include at least one engaging portion 121, the base plate 141 can include at least one buckling portion 1413, and the aforementioned at least one buckling portion 1413 is correspondingly engaged with the aforementioned at least one engaging portion 121. In detail, a number of the buckling portions 1413 is four and each of the buckling portions 1413 has an arm structure. Two of the buckling portions 1413 are located on the first body 1411, and the other two of the buckling portions 1413 are located on the second body 1412. A number of the engaging portions 121 of the base 120 is four and each of the engaging portions 121 is a hole structure. By the mean that each of the buckling portions 1413 is buckled in each of the engaging portion 121, the base 120 can be combined with the installing assembly 140. Hence, when the user secures the installing assembly 140 on the article S1 and then combines the base 120 with the base plate 141, the lace can be coupled to the eyelets and inserted into the spool 134 of the reel part 130. After the lace passes out from the bottom of the spool 134 and is exposed beyond the upper case body 133, the user can tie the lace to restrict the lace such that the lace can be coupled to the reel part 130. Then, the reel part 130 is engaged with the base 120, and the installing can be completed.

In the configuration, the installing assembly 140 can further include at least one pivot hole 143. The at least one pivot hole 143 is located at the base plate 141 and configured for the aforementioned at least one needle 142 to be pivotally disposed thereon. The at least one needle 142 can include an inserting section 1421 and a pivot section 1422. The inserting section 1421 and the pivot section 1422 are connected to form an L-shape. The inserting section 1421 rotates relatively to the base plate 141 about the pivot section 1422 which can be served as the rotary axis. Because a space can be formed in the pivot hole 143 for the inserting section 1421 to be disposed therein, the inserting section 1421 can be switched from the location parallel to the base plate 141 in FIG. 2 to the location perpendicular to the base plate 141 in FIG. 6.

According to the 1st embodiment in FIGS. 1-6, a number of the needles 142 can be two, and a number of the pivot holes 143 can be two. The needles 142 are located on the first body 1411 and the second body 1412, respectively. The pivot holes 143 are located on the first body 1411 and the second body 1412, respectively. Hence, one of the needles 142 can be pivotally disposed on the first body 1411, and the other one of the needles 142 can be pivotally disposed on the second body 1412. It is specified to be mentioned that, in the 1st embodiment, the needles 142 are fixed to the base plate 141, and the term "fixed" here does not mean the fixing during the manufacturing, but means that the needles 142 cannot be detachably disposed on the base plate 141.

Moreover, the installing assembly 140 can further include two through holes 146. As shown in FIG. 4, because the base plate 141 includes the first body 1411 and the second body 1412, one of the through holes 146 penetrates the first body 1411 along a thickness direction of the first body 1411, the other one of the through holes 146 penetrates the second body 1412 along a thickness direction of the second body 1412, and each of the through holes 146 corresponds to each inserting section 1421 of each of the needles 142. Hence, when the needles 142 are inserted into the article S1, if a part of the article S1 protrudes upward, the part of the article S1 can be stored in the through holes 146, and the base plate 141 can be prevented from tilting by pushing of the article S1.

Figure 7:
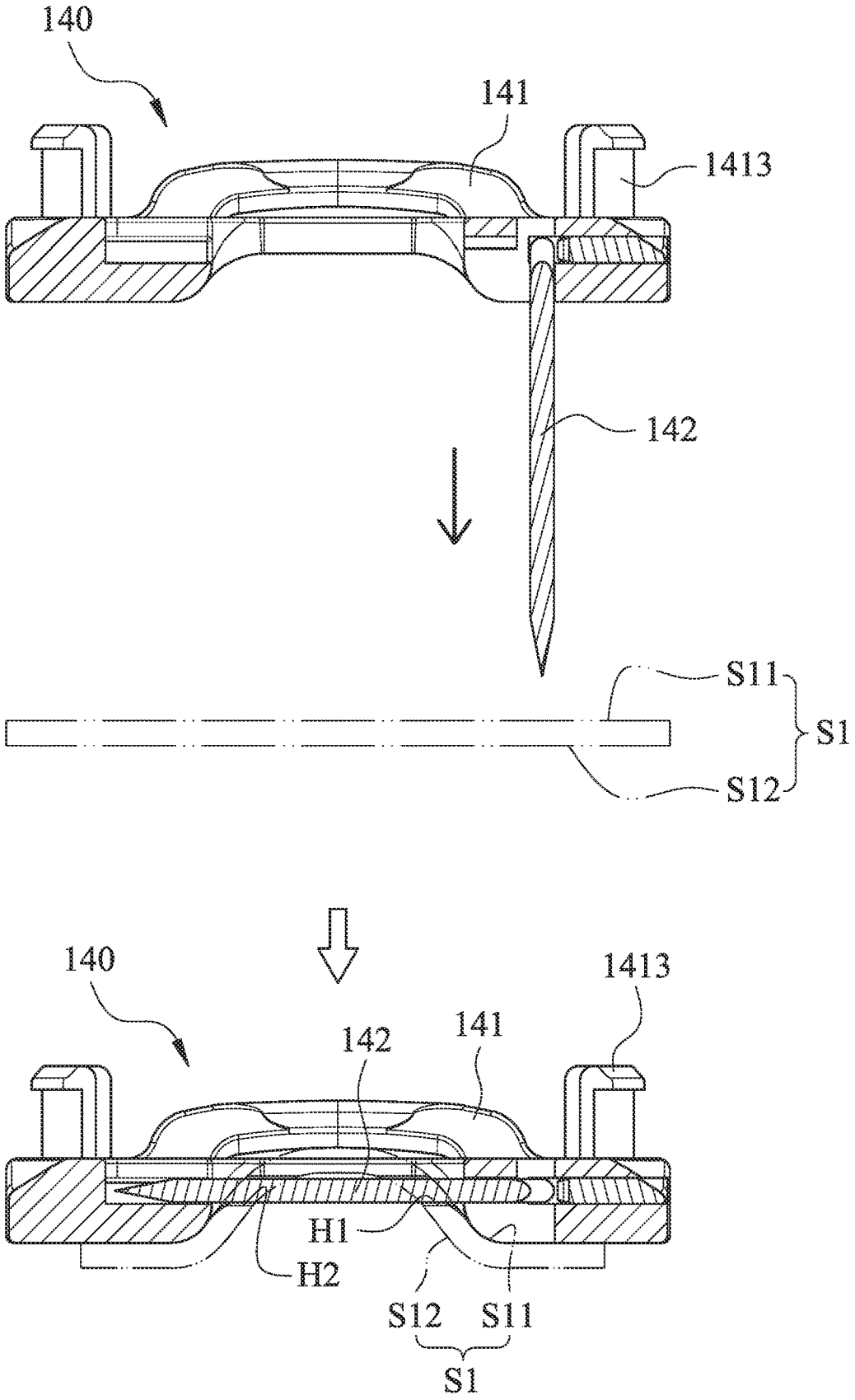
FIG. 7 shows an operation flow of the installing assembly of the fastening device taken along line 7-7 of the 1st embodiment in FIG. 6.
Figure 8:
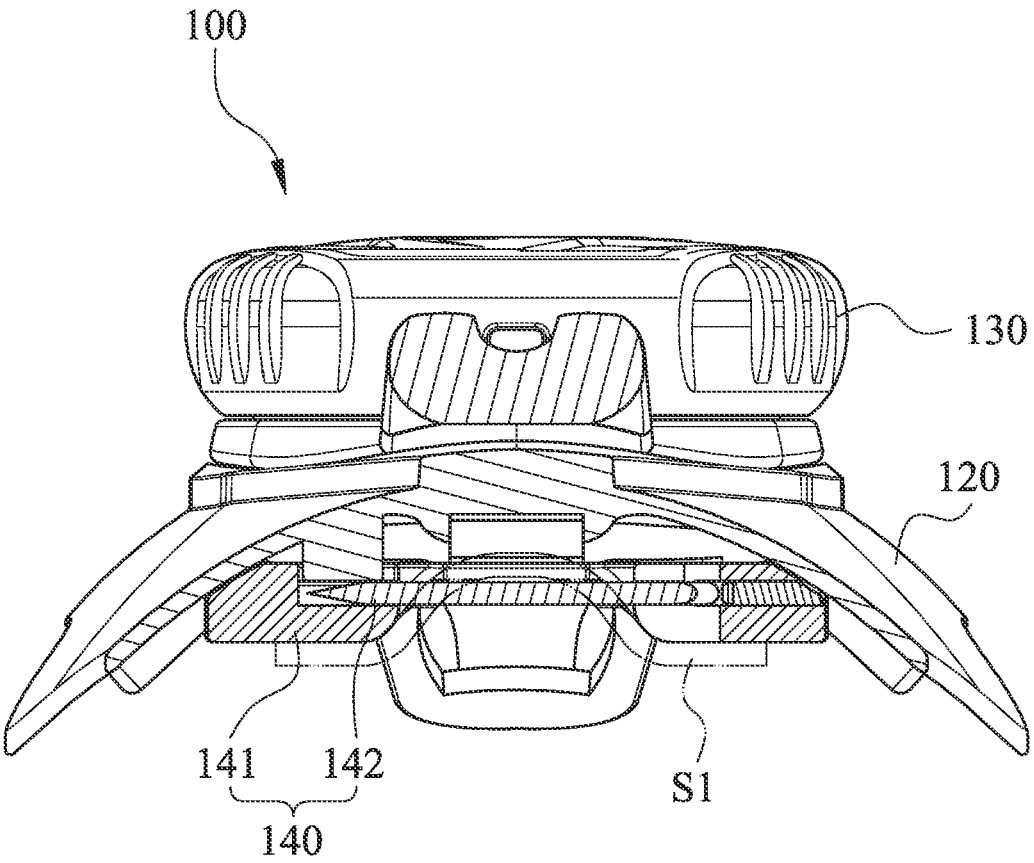
FIG. 8 shows a cross-sectional schematic view of the fastening device of the 1st embodiment in FIG. 1 secured on the article.

Please refer to FIGS. 7 and 8. FIG. 7 shows an operation flow of the installing assembly 140 of the fastening device 100 taken along line 7-7 of the 1st embodiment in FIG. 6. FIG. 8 shows a cross-sectional schematic view of the fastening device 100 of the 1st embodiment in FIG. 1 secured on the article S1. As shown in FIG. 7, each of the needles 142 has been switched to the inserting location perpendicular to the base plate 141, so the needles 142 can be inserted from the first surface S11 of the article S1 into the second surface S12 of the article S1 to form the inserting holes H1. Without being taken out, the needles 142 can be inserted directly from the second surface S12 of the article S1 into the first surface S11 of the article S1 to form other inserting holes H2. Hence, the base plate 141 can be fixed to the first surface S11 of the article S1. Then, the base 120 and the reel part 130 are assembled, and the fastening device 100 is installed on the article S1 as shown in FIG. 8.

Figure 9:
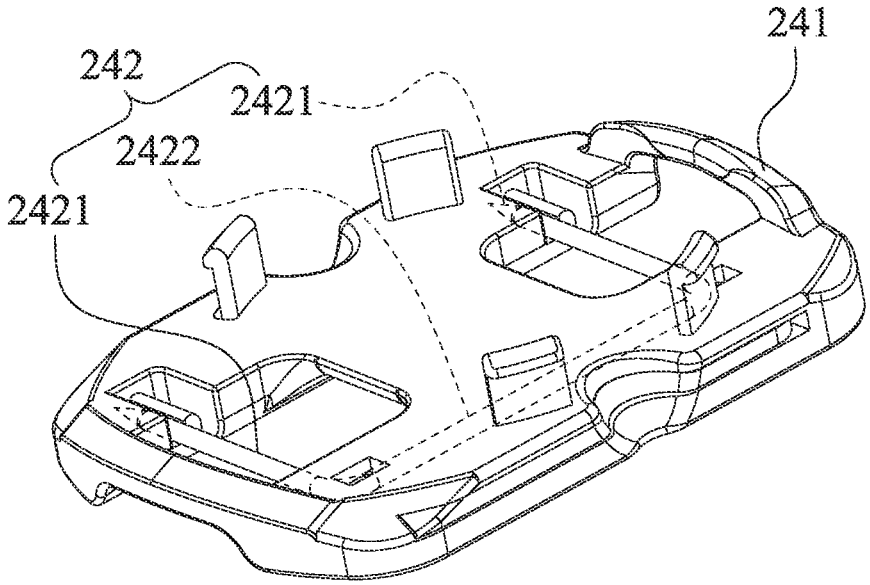
FIG. 9 shows a three-dimensional schematic view of an installing assembly of a fastening device according to the 2nd embodiment of the present disclosure.

Please refer to FIG. 9. FIG. 9 shows a three-dimensional schematic view of an installing assembly 240 of a fastening device according to the 2nd embodiment of the present disclosure. The fastening device of the 2nd embodiment is similar with the fastening device 100 of the 1st embodiment, and the only difference is the structure of the installing assembly 240. In detail, a base plate 241 of the installing assembly 240 is an integrated structure and a number of the pivot holes (not shown) is two. A number of the needle 242 is one and the needle 242 includes two inserting sections 2421 and one pivot section 2422. The two inserting sections 2421 and the pivot section 2422 are connected to form a U-shape, and each of the two inserting sections 2421 corresponds to each of the two pivot holes.

Figure 10:
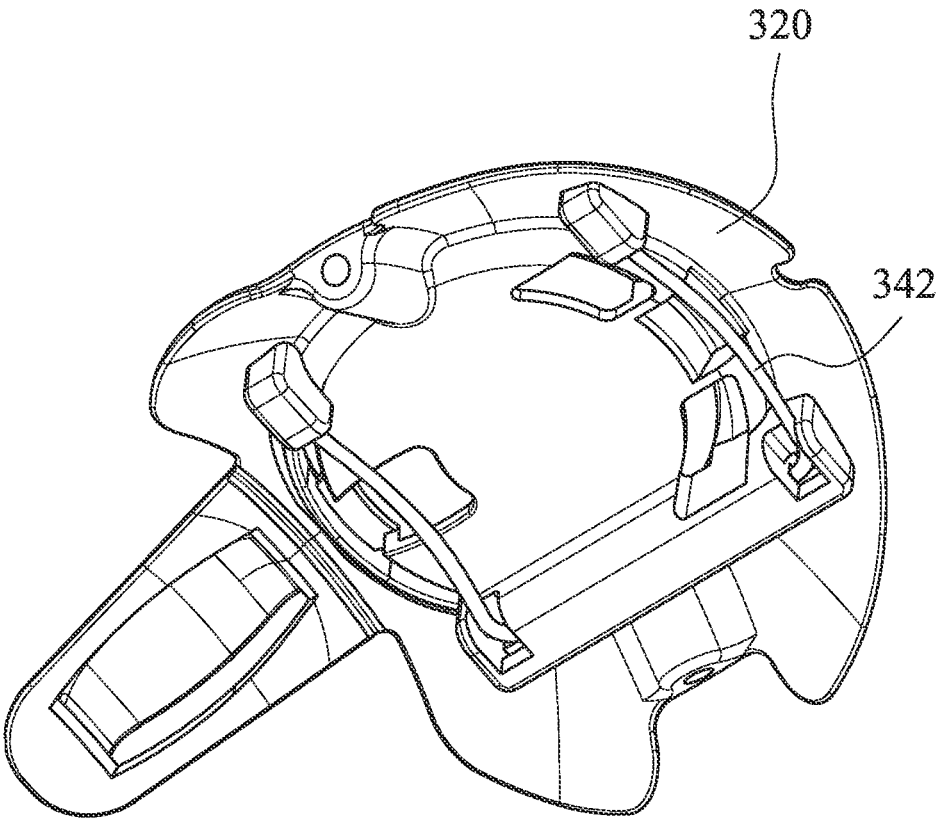
FIG. 10 shows a schematic view of a base and a needle of a fastening device according to the 3rd embodiment of the present disclosure.

Please refer to FIG. 10. FIG. 10 shows a schematic view of a base 320 and a needle 342 of a fastening device according to the 3rd embodiment of the present disclosure. The fastening device of the 3rd embodiment is similar with the fastening device 100 of the 1st embodiment, and the only difference is that the installing assembly does not include a base plate. Thus, the base 320 can include at least one pivot hole (not shown). The at least one pivot hole is located at a base body of the base 320 and configured for the at least one needle 342 to be pivotally disposed thereon. Hence, the aforementioned at least one needle 342 can be pivotally disposed on the base 320 directly. Moreover, the aforementioned at least one needle 342 can be arc-shaped so as to avoid pressing against the instep of a foot.

Figure 11:
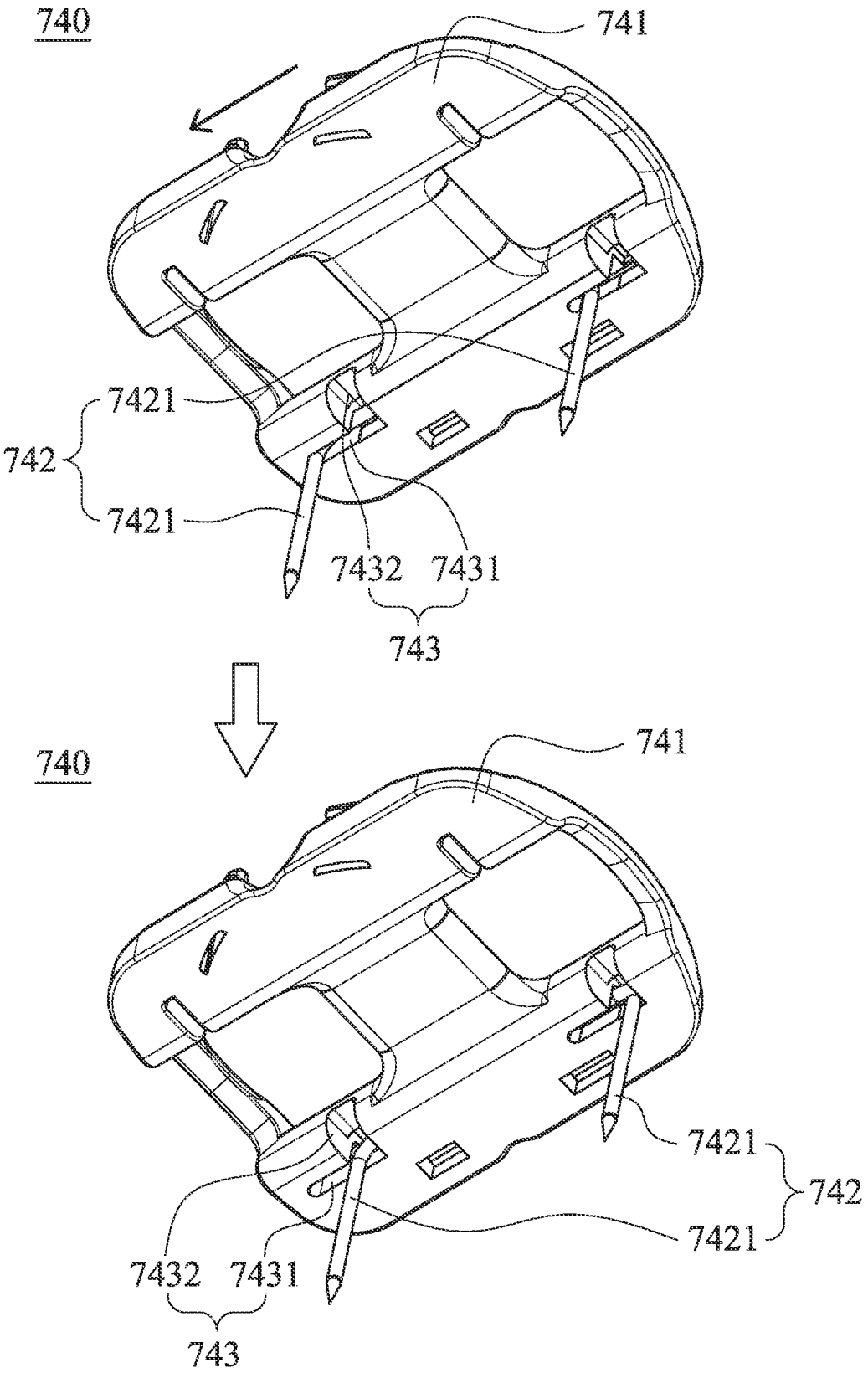
FIG. 11 shows an operation flow of an installing assembly of a fastening device according to the 4th embodiment of the present disclosure.

Please refer to FIG. 11. FIG. 11 shows an operation flow of an installing assembly 740 of a fastening device according to the 4th embodiment of the present disclosure. The fastening device of the 4th embodiment is similar with the fastening device of the 2nd embodiment, and the only difference is that each of pivot holes 743 of the installing assembly 740 can include a restricting section 7431 and an unlocking section 7432. Each of the unlocking sections 7432 is communicated with and perpendicular to each of the restricting sections 7431. Each of the inserting sections 7421 is in a locked state when received in each of the restricting sections 7431, and each of the inserting sections 7421 is in an unlocked state when received in each of the unlocking sections 7432.

In detail, each of the restricting sections 7431 and each of the unlocking sections 7432 are connected to form an L-shape. With the configuration, each of the inserting sections 7421 is received in each of the restricting sections 7431 so that each of the needles 742 cannot rotate relatively to a base plate 741. The base plate 741 is positioned in a restricting location so that the needles 742 are in the locked state. Because each of the inserting sections 7421 cannot rotate, the inserting sections 7421 can be remained in an inserting direction which is favorable for the user to insert the inserting sections 7421 into the article. After each of the inserting sections 7421 is inserted into the article, the user can push the base plate 741 so that the base plate 741 can be positioned in an unlocked state. Via a space of each of the unlocking sections 7432 which allows each of the inserting sections 7421 to be in the unlocked state and rotate relatively to the base plate 741, the base plate 741 can be parallel disposed on the first surface of the article.

Figure 12:
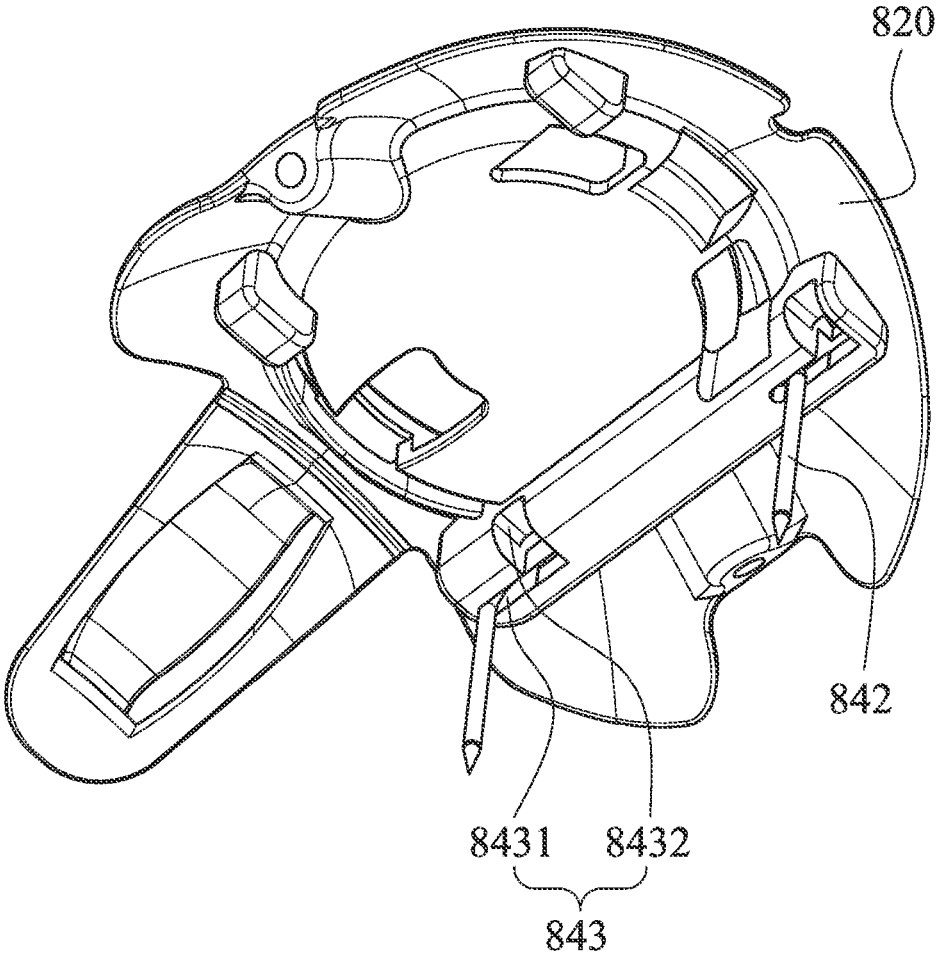
FIG. 12 shows a schematic view of a base and needles of a fastening device according to the 5th embodiment of the present disclosure.

Please refer to FIG. 12. FIG. 12 shows a schematic view of a base 820 and needles 842 of a fastening device according to the 5th embodiment of the present disclosure. The base 820 and the needles 842 of the 5th embodiment are similar with the base 320 and the needles 342 of the 3rd embodiment, but each of pivot holes 843 of the 5th embodiment includes a restricting section 8431 and an unlocking section 8432. The structures and the functions of the restricting section 8431 and the unlocking section 8432 are the same as the structures and the functions of the restricting section 7431 and the unlocking sections 7432 of the 4th embodiment, and it will not be mentioned again here.

Figure 13:
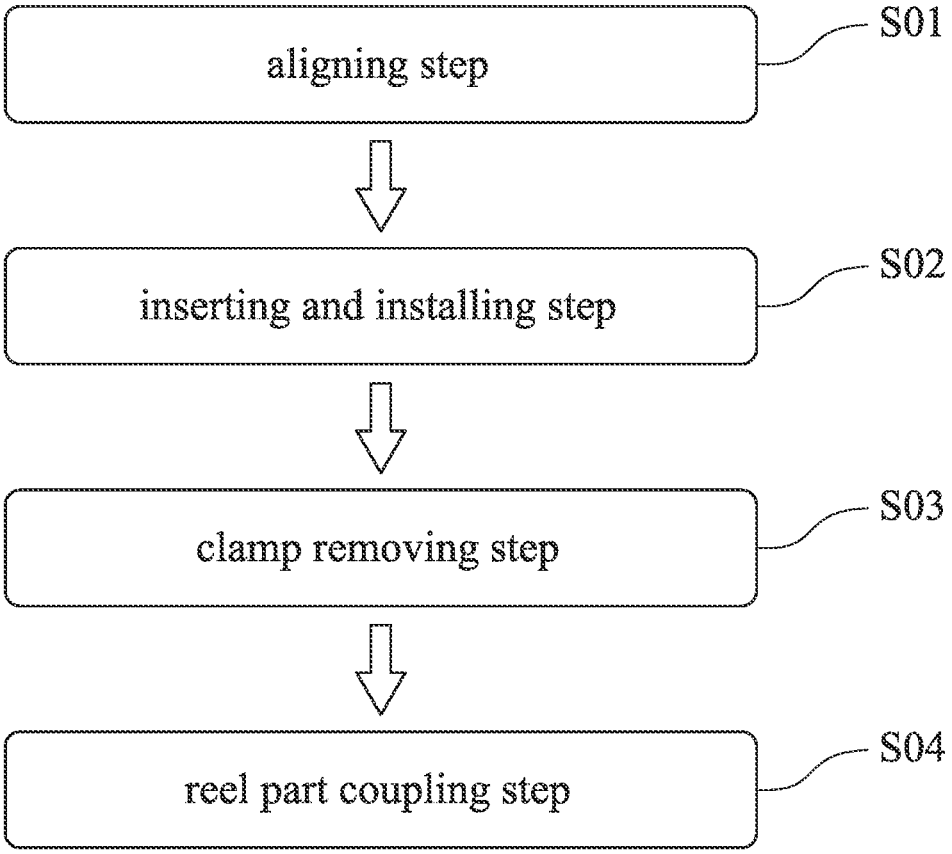
FIG. 13 shows a block diagram of a method for installing a fastening device according to the 6th embodiment of the present disclosure.
Figure 14:
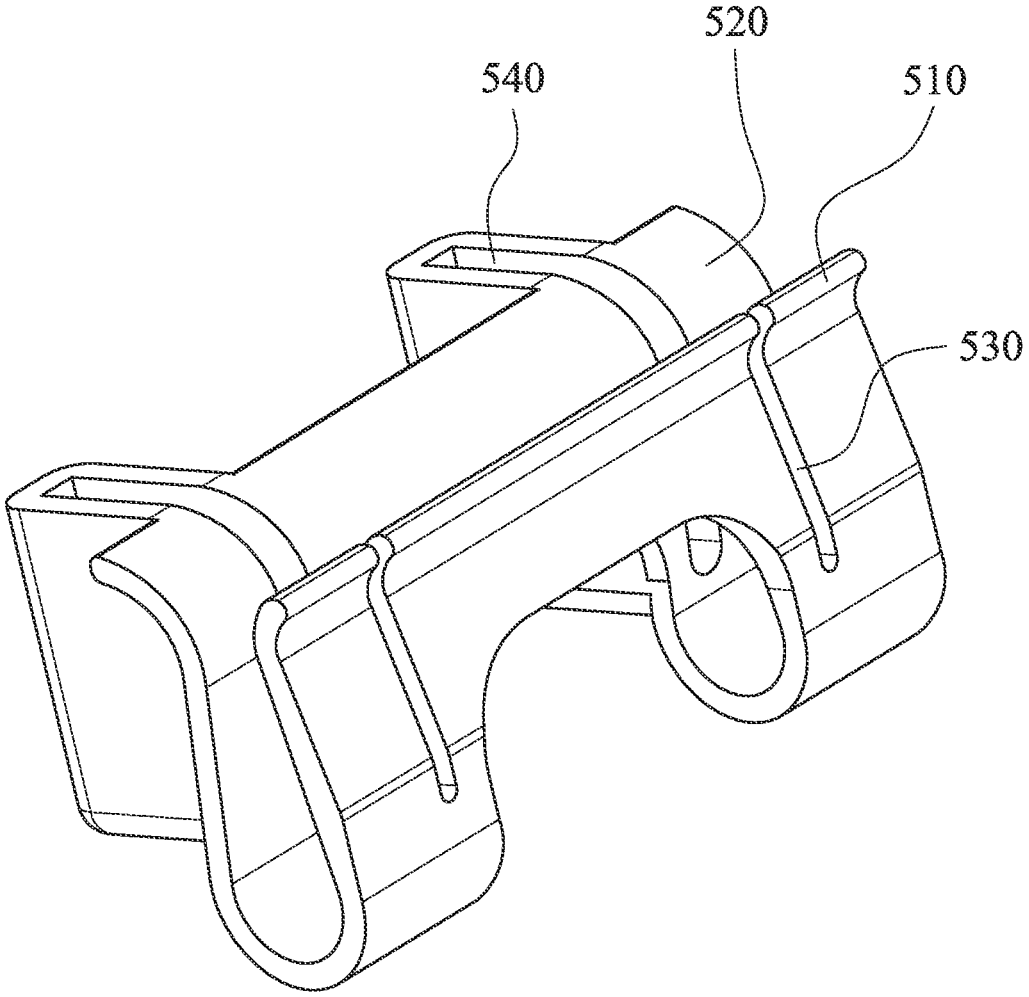
FIG. 14 shows a three-dimensional schematic view of a clamp used in the method of the 6th embodiment in FIG. 13.
Figure 15:
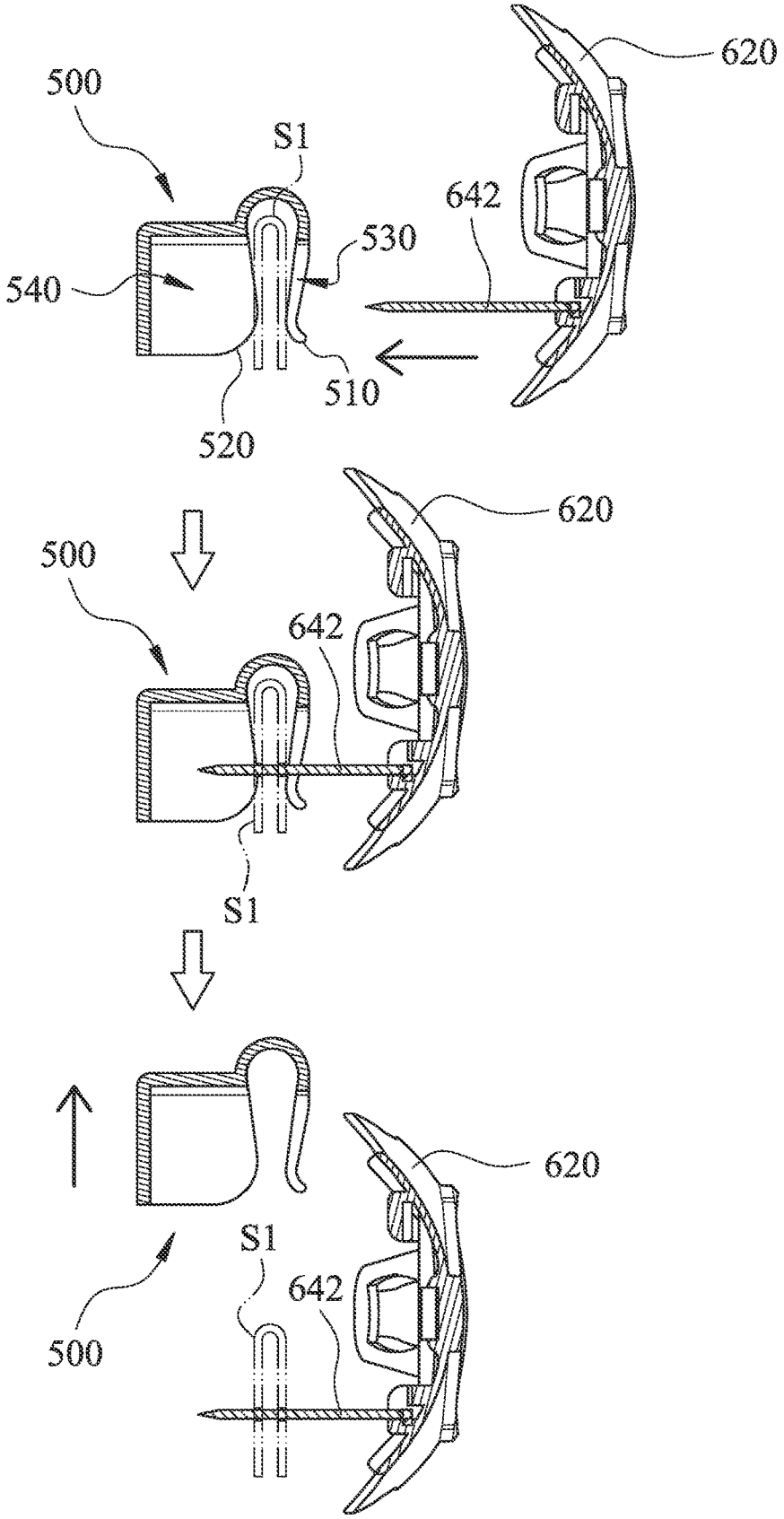
FIG. 15 shows an operation flow of the method of the 6th embodiment in FIG. 13.

Please refer to FIGS. 13, 14 and 15. FIG. 13 shows a block diagram of a method 400 for installing a fastening device according to the 6th embodiment of the present disclosure. FIG. 14 shows a three-dimensional schematic view of a clamp 500 used in the method 400 of the 6th embodiment in FIG. 13. FIG. 15 shows an operation flow of the method 400 of the 6th embodiment in FIG. 13. The method 400 for installing the fastening device includes performing an aligning step S01 and performing an inserting and installing step S02. The aligning step S01 is to align at least one needle 642 of a fastening device with an article S1. The inserting and installing step S02 is to insert an inserting section (its numeral reference is omitted) of the at least one needle 642 from a first surface (its numeral reference is omitted) of the article S1 into a second surface (its numeral reference is omitted) of the article S1, then insert the inserting section of the at least one needle 642 from the second surface of the article S1 into the first surface of the article S1, and restrict the inserting section of the at least one needle 642 to the article S1.

In detail, in the aligning step S01, the article S1 is bended to form a protrusion, the protrusion is positioned via the clamp 500, the clamp 500 includes two positioning portions 510, 520 which are spaced apart from each other, and the two positioning portions 510, 520 abut against two sides of the protrusion, respectively. In the inserting and installing step S02, the at least one needle 642 is inserted into a groove 530 on the positioning portion 510 of the clamp 500, passed through the protrusion, and then inserted into another groove 540 on the positioning portion 520, so that the at least one needle 642 is restricted to the article S1.

As shown in FIG. 14, the positioning portions 510, 520 are connected to each other to form a U-shaped clamping arm structure. As shown in FIG. 15, the U-shaped clamping arm structure can clamp and position the protrusion. A number of the grooves 530 is two, and the two grooves 530 are spaced apart from each other and disposed on the positioning portion 510. A number of the grooves 540 is two, and the two grooves 540 are spaced apart from each other and disposed on the positioning portion 520. Each of the grooves 530 corresponds to each of the grooves 540. In the configuration, the clamp 500 can be configured to be removed from the article S1 by pulling upwardly, and the at least one needle 642 will not affect the removing. Via the configuration of the clamp 500, it is favorable for the penetration of the at least one needle 642. When the fastening device is equipped with the clamp 500, the method 400 can further include performing a clamp removing step S03 configured for removing the clamp 500 to release the protrusion. In other embodiments, the clamp and the clamp removing step can be excluded, and the present disclosure is not limited thereto.

Furthermore, in the inserting and installing step S02, the aforementioned at least one needle 642 is switched from a locked state to an unlocked state, the at least one needle 642 in the locked state is prohibited from rotating relatively to a base 620 of the fastening device, and after the inserting section of the at least one needle 642 is restricted to the article S1, the at least one needle 642 is switched to the unlocked state so as to allow the at least one needle 642 to rotate relatively to the base 620 of the fastening device.

Moreover, the method 400 can further include performing a reel part coupling step S04. The base 620 is directly connected to the at least one needle 642 such as the base 820 and the needles 842 in FIG. 12. A reel part of the fastening device can be mounted on the base 620 of the fastening device, and the assembly can be completed.

In other embodiments, in the reel part coupling step, a base of the fastening device can be mounted on a base plate of the fastening device, and a reel part of the fastening device can be mounted on the base. The base plate is connected to the aforementioned at least one needle. The fastening device can be the fastening device 100 in FIGS. 1-8, and the base plate and the needle can be the same as the base plate 141 and the needle 142, or the base plate 241 and the needle 242 in FIG. 9.

Figure 16:
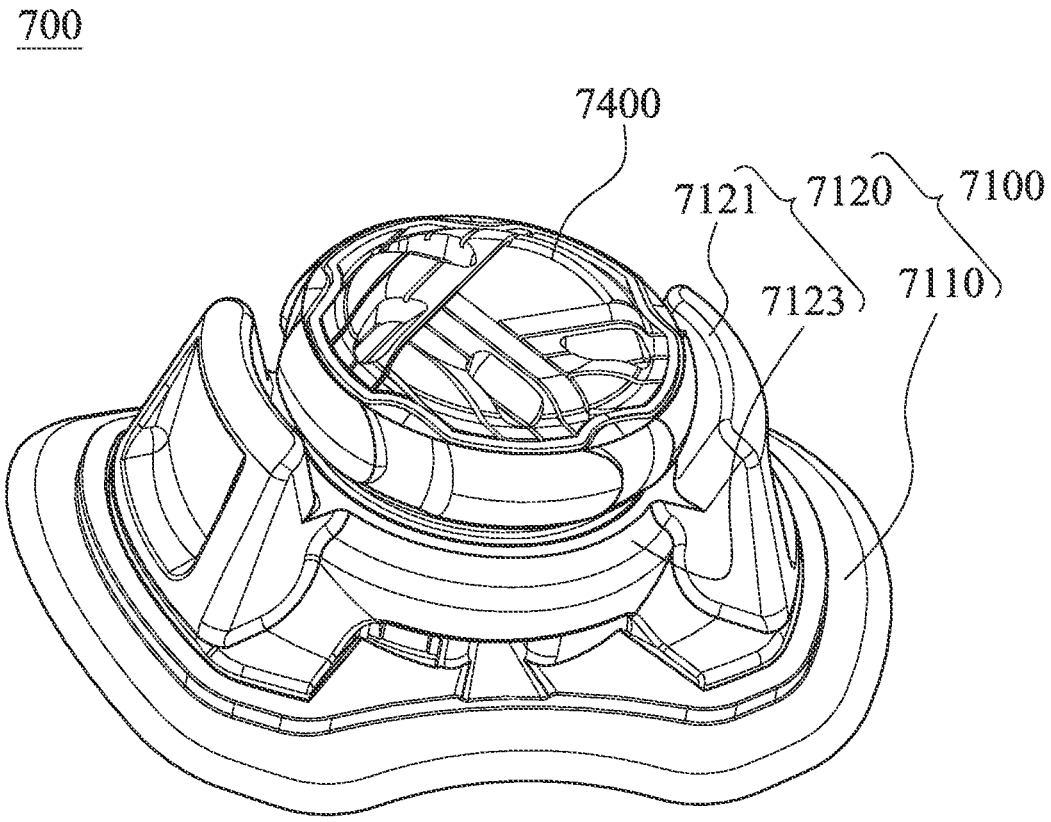
FIG. 16 shows a three-dimensional schematic view of a fastening device according to the 7th embodiment of the present disclosure.
Figure 17:
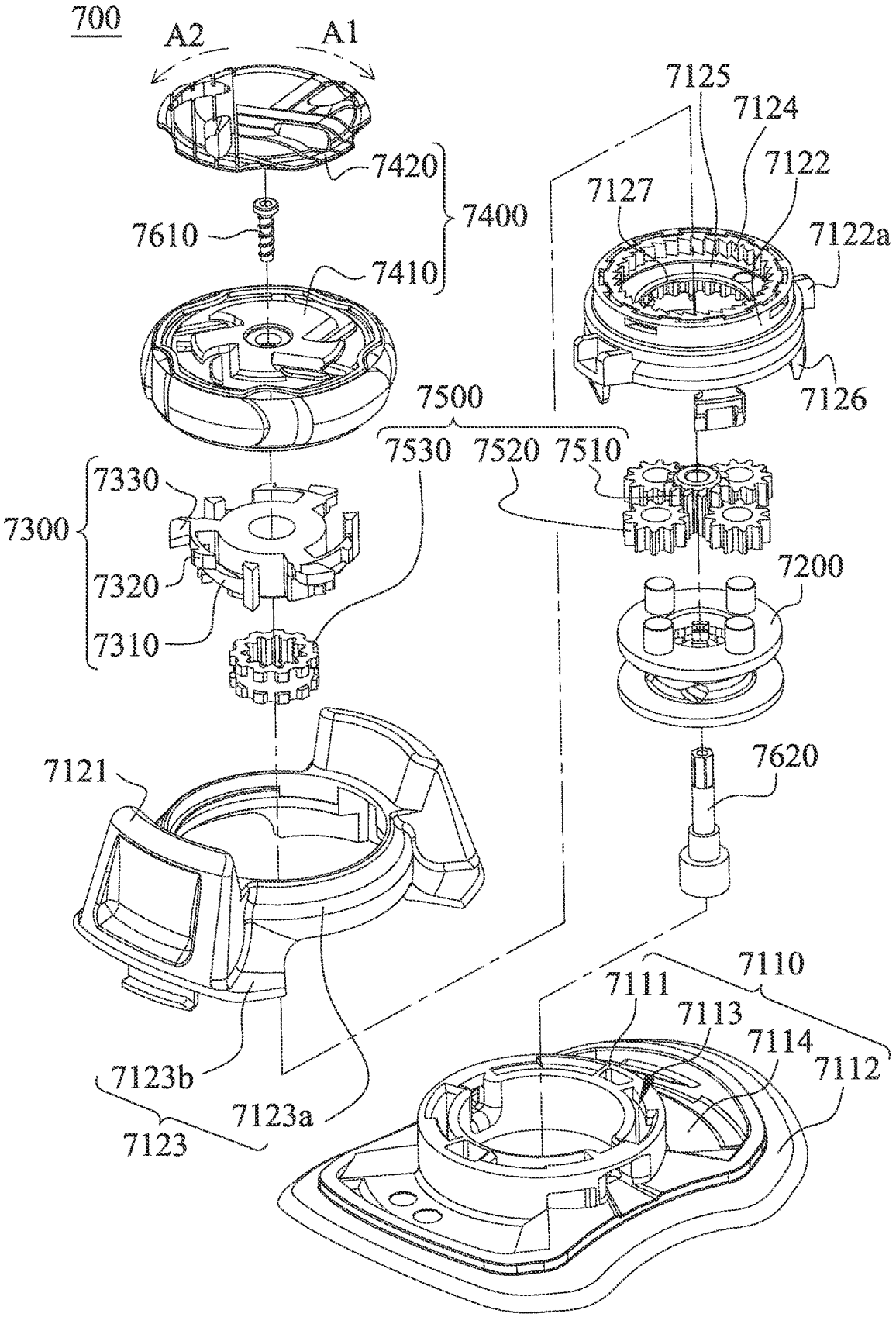
FIG. 17 shows one exploded schematic view of the fastening device of the 7th embodiment in FIG. 16.
Figure 18:
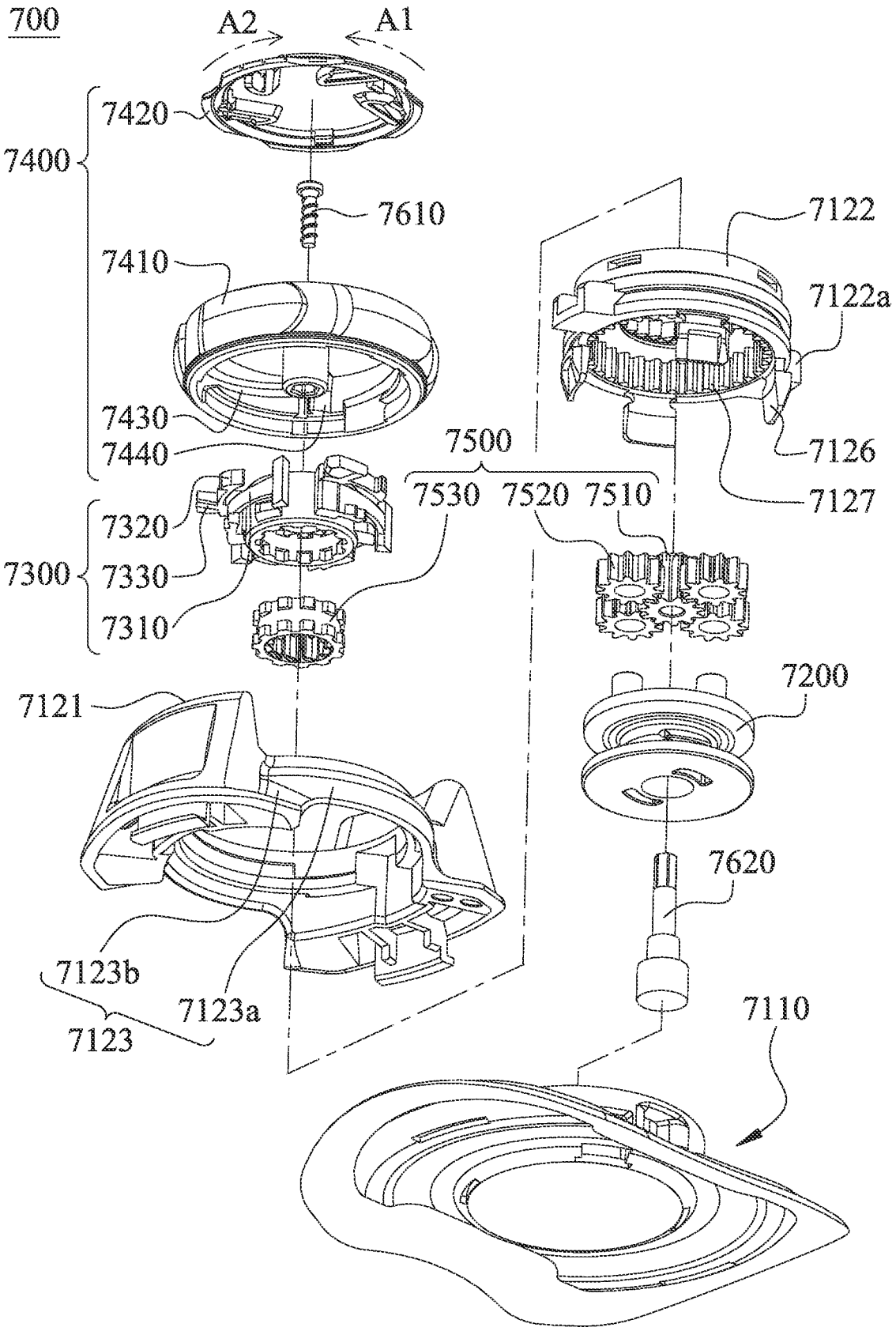
FIG. 18 shows another exploded schematic view of the fastening device of the 7th embodiment in FIG. 16.

FIG. 16 shows a three-dimensional schematic view of a fastening device 700 according to the 7th embodiment of the present disclosure. FIG. 17 shows one exploded schematic view of the fastening device 700 of the 7th embodiment in FIG. 16. FIG. 18 shows another exploded schematic view of the fastening device 700 of the 7th embodiment in FIG. 16. The fastening device 700 includes a case 7100, a spool 7200, an engaging unit 7300 and a knob 7400. The case 7100 includes an upper case body 7120 including at least one protecting wing 7121 extending upward, and a base 7110 detachably coupled to the upper case body 7120. The spool 7200 is disposed within the case 7100, the engaging unit 7300 is disposed above the spool 7200, and the knob 7400 covers the upper case body 7120. In the 7th embodiment, a number of the at least one protecting wing 7121 is two, but the present disclosure is not limited thereto.

The base 7110 includes a housing portion 7111 connected to the upper case body 7120, a base flange 7112 connected to the housing portion 7111, four coupling holes 7113 located at the housing portion 7111, and two mounting areas 7114 located at the base flange 7112. The base flange 7112 is substantially ellipse-shaped, and the two mounting areas 7114 are located at two sides of the housing portion 7111 along a major axis of the base flange 7112. The housing portion 7111 includes a spool space for receiving the spool 7200.

The upper case body 7120 includes an inner annular member 7122 and an outer annular member 7123 surrounding the inner annular member 7122, and the two protecting wings 7121 are respectively connected to two sides of the outer annular member 7123. Precisely, the inner annular member 7122 is connected to the housing portion 7111 of the base 7110. The upper case body 7120 further includes a plurality of engaging teeth 7124 located at an inner wall of a top end of the inner annular member 7122, a partition 7125 located at the inner annular member 7122 and below the engaging teeth 7124 to form an upper chamber for receiving the engaging unit 7300, four lags 7126 extending downward from the inner annular member 7122 to couple to the base 7110, and a plurality of inner teeth 7127 located at the inner annular member 7122 and below the partition 7125. The inner annular member 7122 may include two engaging projections 7122*a* for engaging with the outer annular member 7123.

The outer annular member 7123 includes two mounting flanges 7123*b*, each of the two mounting flanges 7123*b* is disposed at the base 7110, especially the mounting area 7114, and each of the two protecting wings 7121 extends upward from each of the two mounting flanges 7123*b*. Moreover, the outer annular member 7123 further includes an annular portion 7123*a* surrounding the inner annular member 7122, and the two mounting flanges 7123*b* respectively extend from two sides of the annular portion 7123*a*.

The fastening device 700 further includes a transmitting set 7500 located above the spool 7200. The transmitting set 7500 includes a sun gear 7510, four planet gears 7520 and a transmitting gear 7530. The four planet gears 7520 are coupled to the spool 7200 and are located between the partition 7125 and the spool 7200. The planet gears 7520 are engaged with the inner teeth 7127. The transmitting gear 7530 is located in the upper chamber and coupled to the engaging unit 7300. The sun gear 7510 is coupled to the transmitting gear 7530 and the planet gears 7520.

The engaging unit 7300 includes three pawl arms 7310 corresponding with the engaging teeth 7124, three retaining arms 7320 coupled to the knob 7400, and three guiding portions 7330. The knob 7400 includes a covering body 7410, a top body 7420, three guiding tracks 7430 and three pushing portions 7440. The covering body 7410 covers the inner annular member 7122, the guiding tracks 7430 and the pushing portions 7440 are located at the inner side wall of the covering body 7410, each of the guiding tracks 7430 is for receiving each of the guiding portions 7330, and each of the pushing portions 7440 corresponds to each of the retaining arms 7320.

The fastening device 700 further includes a connecting set 7600 (labeled in FIG. 19) including a central post 7620 and a screw member 7610, the central post 7620 passes through the spool 7200 upward, and the screw member 7610 passes through the covering body 7410 downward to screw into the central post 7620. The top body 7420 is disposed at the top of the covering body 7410 and hides the screw member 7610.

Figure 19:
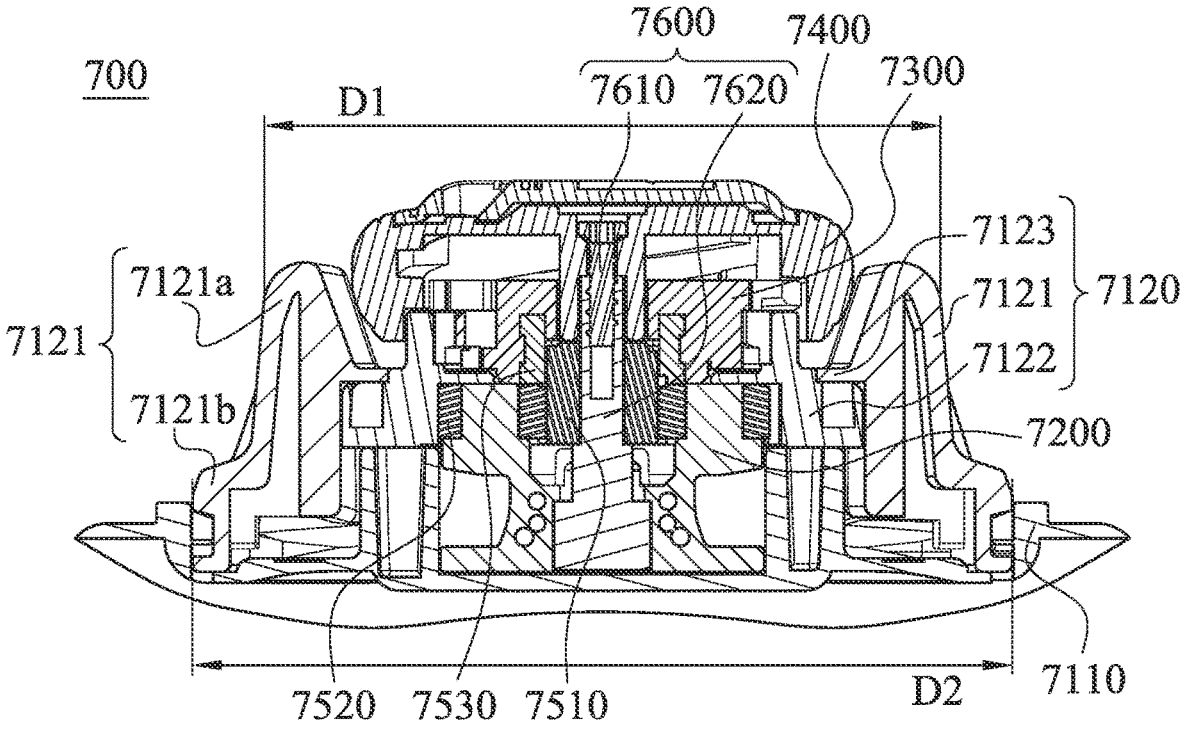
FIG. 19 shows one cross-sectional schematic view of the fastening device of the 7th embodiment in FIG. 16.
Figure 20:
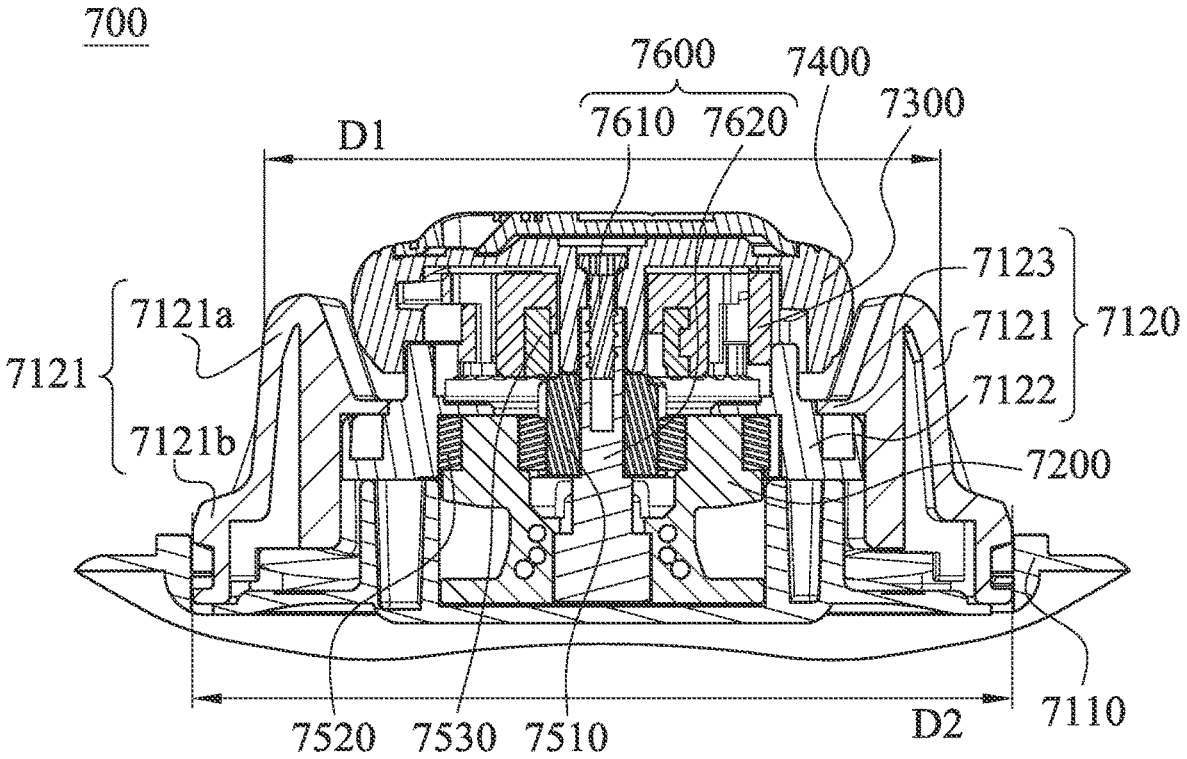
FIG. 20 shows another cross-sectional schematic view of the fastening device of the 7th embodiment in FIG. 16.

FIG. 19 shows one cross-sectional schematic view of the fastening device 700 of the 7th embodiment in FIG. 16. FIG. 20 shows another cross-sectional schematic view of the fastening device 700 of the 7th embodiment in FIG. 16. In the 7th embodiment, each of the two protecting wings 7121 has a top portion 7121*a* and a bottom portion 7121*b*, each of the top portions 7121*a* has a first radial outer-most edge, each of the bottom portions 7121*b* has a second radial outer-most edge, and a distance D1 between the two first radial outer-most edges is equal to or smaller than a distance D2 between the two second radial outer-most edges. Moreover, the upper case body 7120 includes an upper opening located at the inner annular member 7122, and each of the two protecting wings 7121 is higher than the upper opening. In the 7th embodiment, D1 is smaller than D2, thus the bottom portion 7121*b* is wider than the top portion 7121*a*, and therefore the bottom portion 7121*b* slops toward the top portion 7121*a*. Moreover, since at least a portion of each of the two protecting wings 7121 is higher than a lower edge of the knob 7400, and each of the two protecting wings 7121 is higher than the upper opening, the knob 7400 can be protected by the protecting wings 7121.

As shown in FIG. 19, the engaging unit 7300 is located at a first position, the knob 7400 can be rotated in a tensioning direction A1 to allow the pawl arms 7310 to disengage from the engaging teeth 7124, and the engaging unit 7300 drives the transmitting set 7500 to rotate the spool 7200 for tensioning the lace. As the knob 7400 stops, the pawl arms 7310 are engaged with the engaging teeth 7124, and the lace is secured.

Moreover, as shown in FIG. 20, as the knob 7400 is rotated in a releasing direction A2, the pushing portion 7440 displaces the retaining arm 7320, and the knob 7400 is rotated relative to the engaging unit 7300. Meanwhile, the guiding portion 7330 is guided by the guiding track 7430, and the engaging unit 7300 is lifted. The transmitting gear 7530 is disengaged from the sun gear 7510, and the lace is released.

Figure 21:
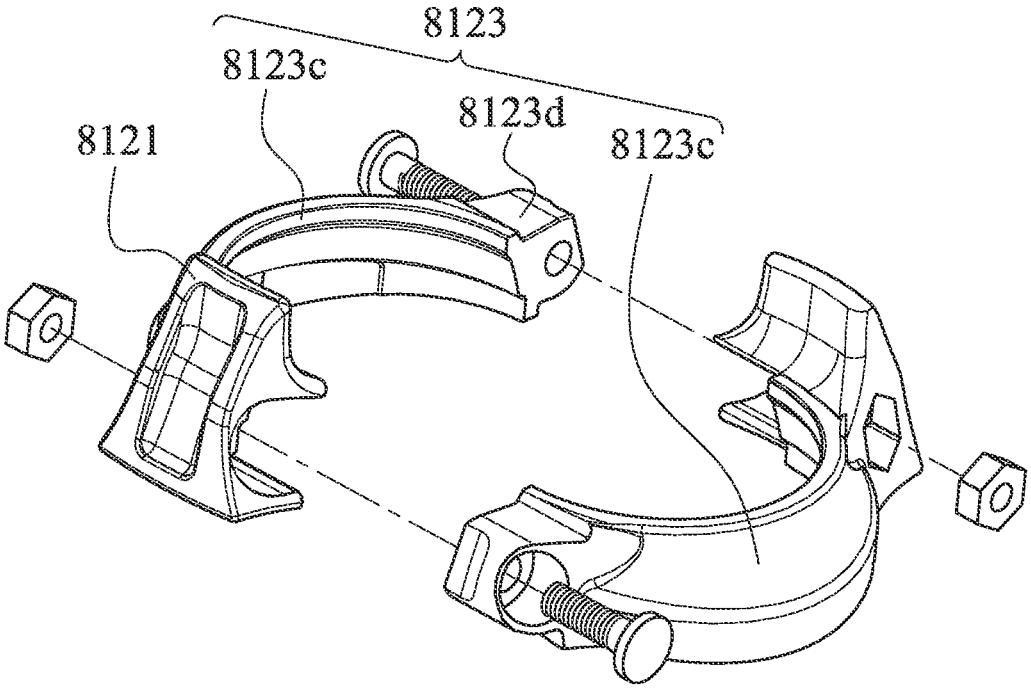
FIG. 21 shows one three-dimensional schematic view of an outer annular member and protecting wings of a fastening device according to the 8th embodiment of the present disclosure.
Figure 22:
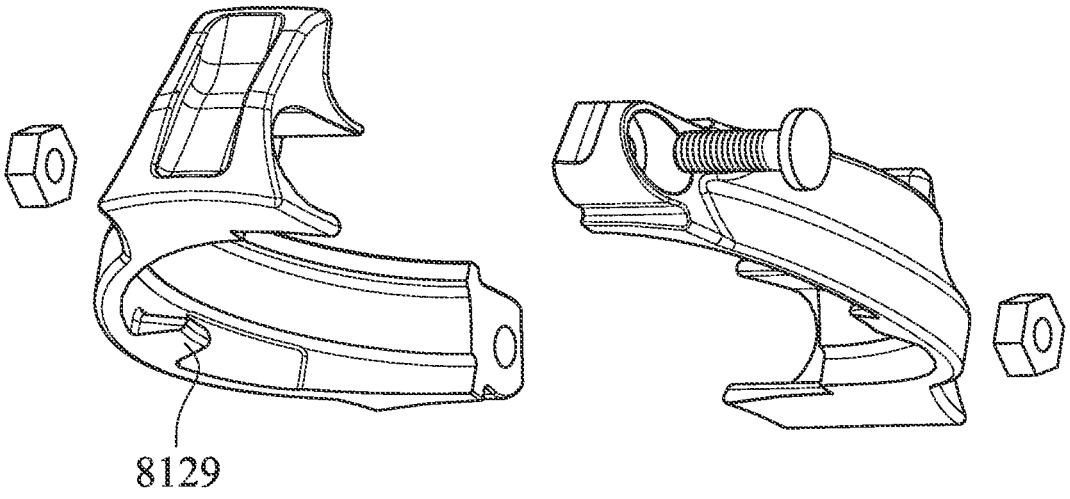
FIG. 22 shows another three-dimensional schematic view of the outer annular member and the protecting wings of the fastening device of the 8th embodiment of FIG. 21.

FIG. 21 shows one three-dimensional schematic view of an outer annular member 8123 and protecting wings 8121 of a fastening device according to the 8th embodiment of the present disclosure. FIG. 22 shows another three-dimensional schematic view of the outer annular member 8123 and the protecting wings 8121 of the fastening device of the 8th embodiment of FIG. 21. The outer annular member 8123 includes two combining portions 8123*c* detachably connected to each other, and each of the protecting wings 8121 is connected to each of the combining portions 8123*c*. To be more specific, each of the combining portions 8123*c* is circular-shaped, the outer annular member 8123 includes an assembling portion 8123*d* connected at one end of the combining portion 8123*c*, the protecting wing 8121 is connected to the other end of the combining portion 8123*c*, and an groove is formed in the protecting wing 8121. The outer annular member 8123 may further include two tabs 8129, each of the tabs 8129 extends inward from a bottom of each of the combining portions 8123*c*, and the tabs 8129 are coupled to the inner annular member or the base. For the 8th embodiment, as the two combining portions 8123*c* surround the inner annular member of the upper case body with the tabs 8129 coupling to the inner annular member, the assembling portions 8123*d* respectively insert into the grooves of the protecting wings 8121, and two screws can be respectively inserted into the two assembling portions 8123*d* to respectively fasten with two nuts in the protecting wings 8121.

Figure 23:
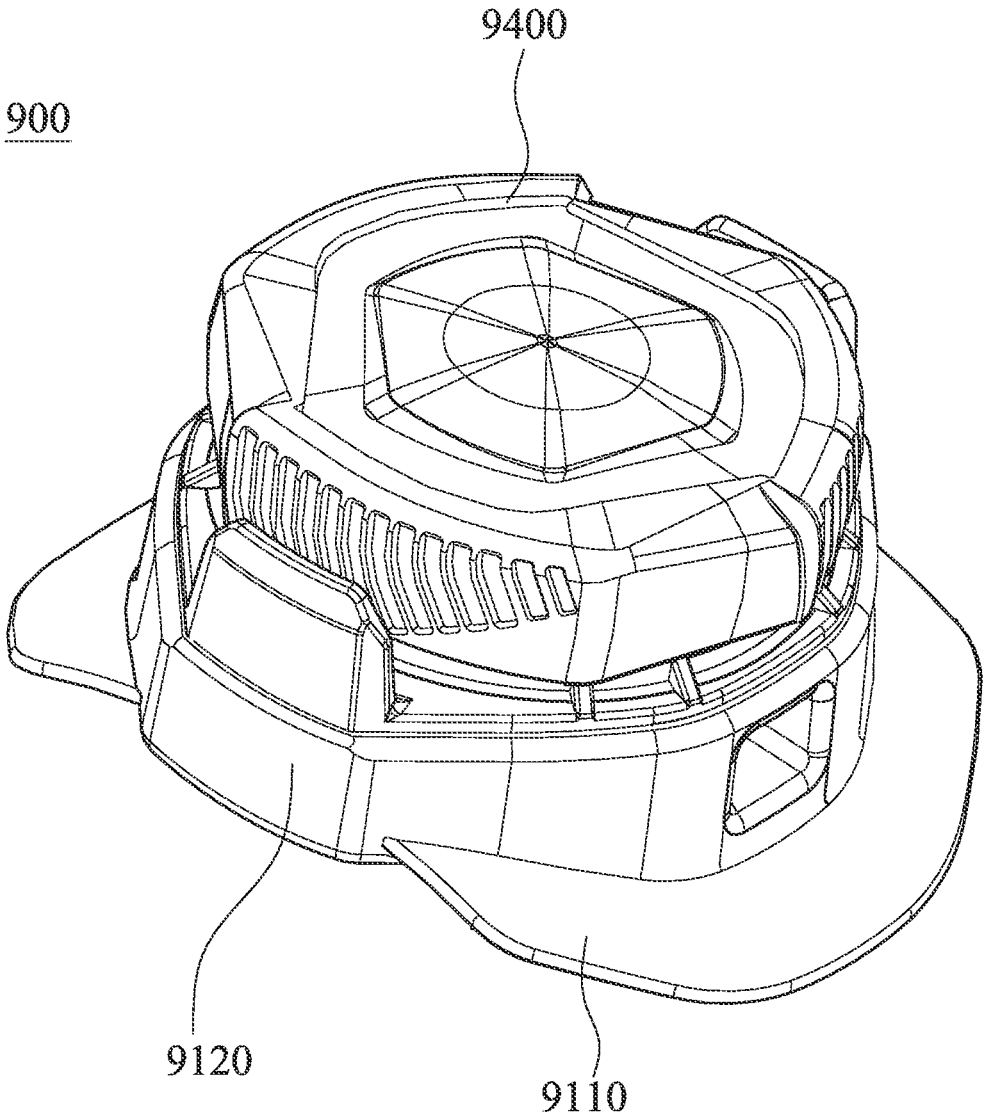
FIG. 23 shows a three-dimensional schematic view of a fastening device according to the 9th embodiment of the present disclosure.
Figure 24:
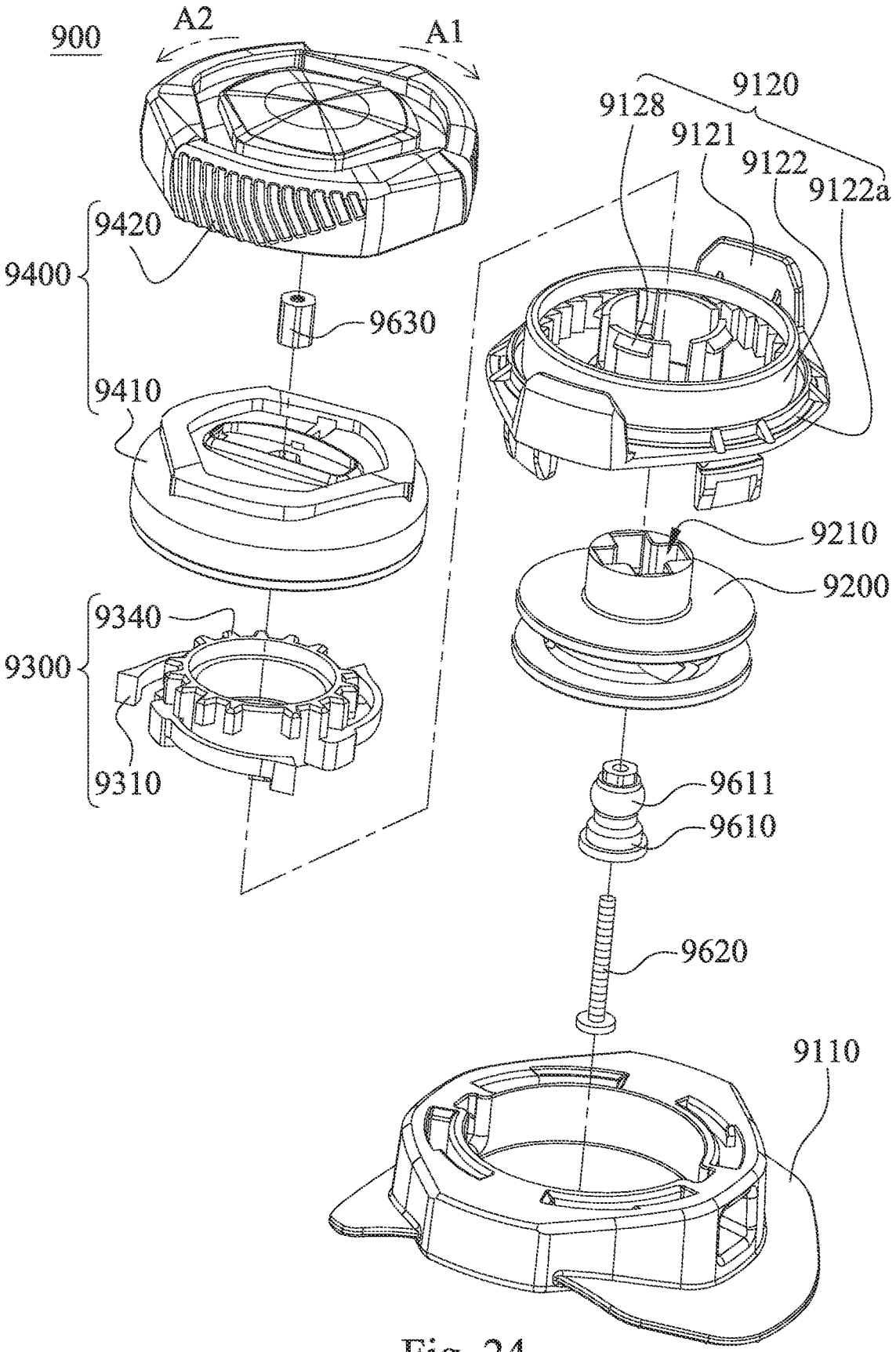
FIG. 24 shows one exploded schematic view of the fastening device of the 9th embodiment in FIG. 23.
Figure 25:
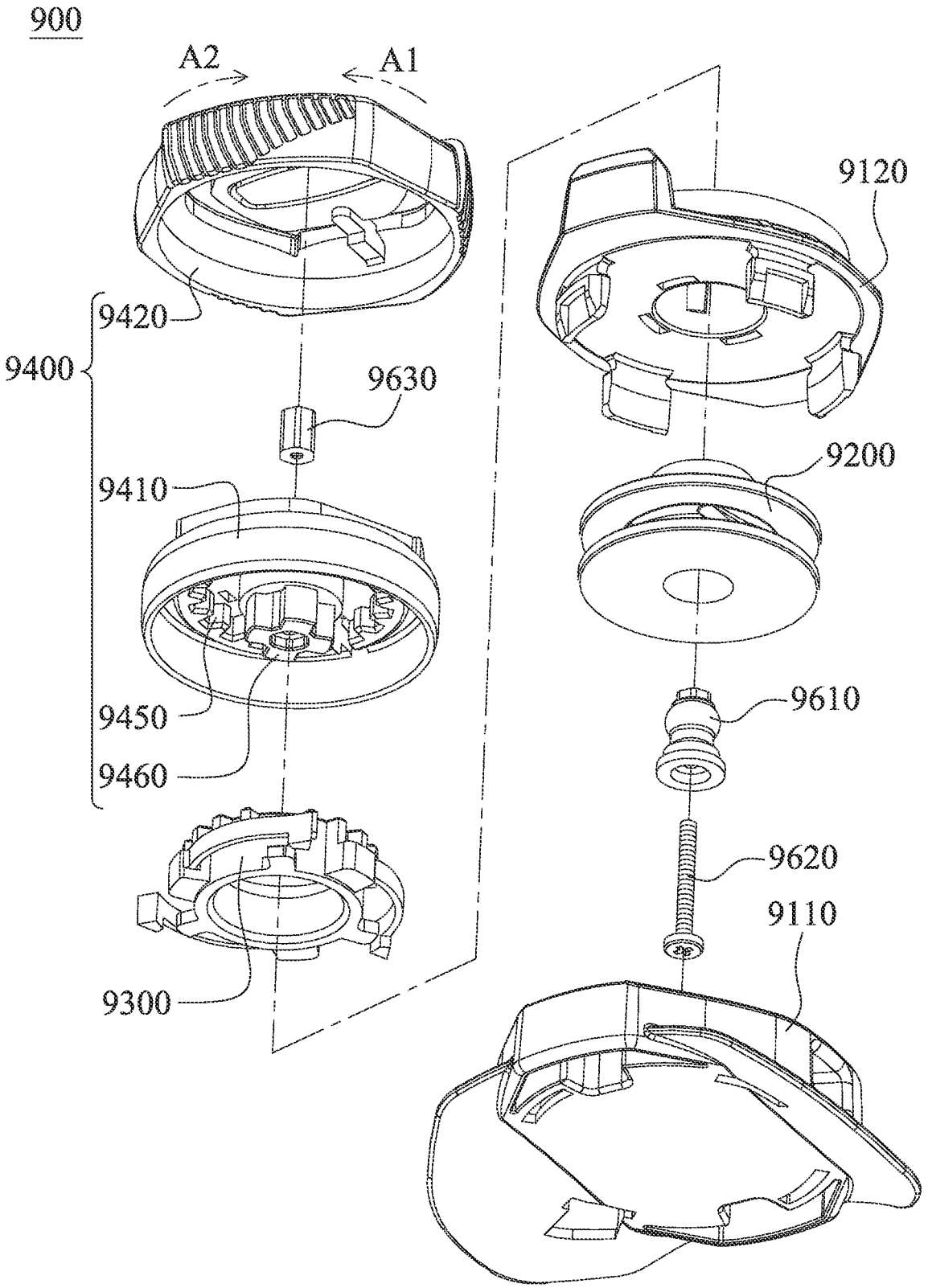
FIG. 25 shows another exploded schematic view of the fastening device of the 9th embodiment in FIG. 23.

FIG. 23 shows a three-dimensional schematic view of a fastening device 900 according to the 9th embodiment of the present disclosure. FIG. 24 shows one exploded schematic view of the fastening device 900 of the 9th embodiment in FIG. 23. FIG. 25 shows another exploded schematic view of the fastening device 900 of the 9th embodiment in FIG. 23. The fastening device 900 includes a case, a spool 9200, an engaging unit 9300, a knob 9400 and a connecting unit 9600 (labeled in FIG. 26). The case includes a base 9110 and an upper case body 9120. The upper case body 9120 includes two protecting wings 9121 and an inner annular member 9122. The inner annular member 9122 includes an annular flange 9122*a* for connecting the two protecting wings 9121, and the annular flange 9122*a* is rested on the housing portion of the base 9110. A gap is formed between the inner surface of the annular flange 9122*a* and the outer surface of the inner annular member 9122, and a portion of the knob 9400 inserts the gap. The upper case body 9120 further includes clamping portions 9128 for coupling the engaging unit 9300.

The engaging unit 9300 includes a plurality of driving teeth 9340 coupled to a plurality of knob teeth 9450 of the knob 9400. Precisely, the knob 9400 includes an inner covering body 9410 and an outer covering body 9420 covering the inner covering body 9410, and the knob teeth 9450 are located at an inner top surface of the inner covering body 9410. The knob 9400 may further include a driving boss 9460 for inserting a driving hole 9210 of the spool 9200. Moreover, the connecting unit 9600 includes positioning post 9610, a screw member 9620 and a nut 9630. The positioning post 9610 inserts the spool 9200 to couple to a flexible coupling portion 9220 (labeled in FIG. 26) of the spool 9200. The screw member 9620 passes through the positioning post 9610 upward to fasten with the nut 9630 within the knob 9400.

Figure 26:
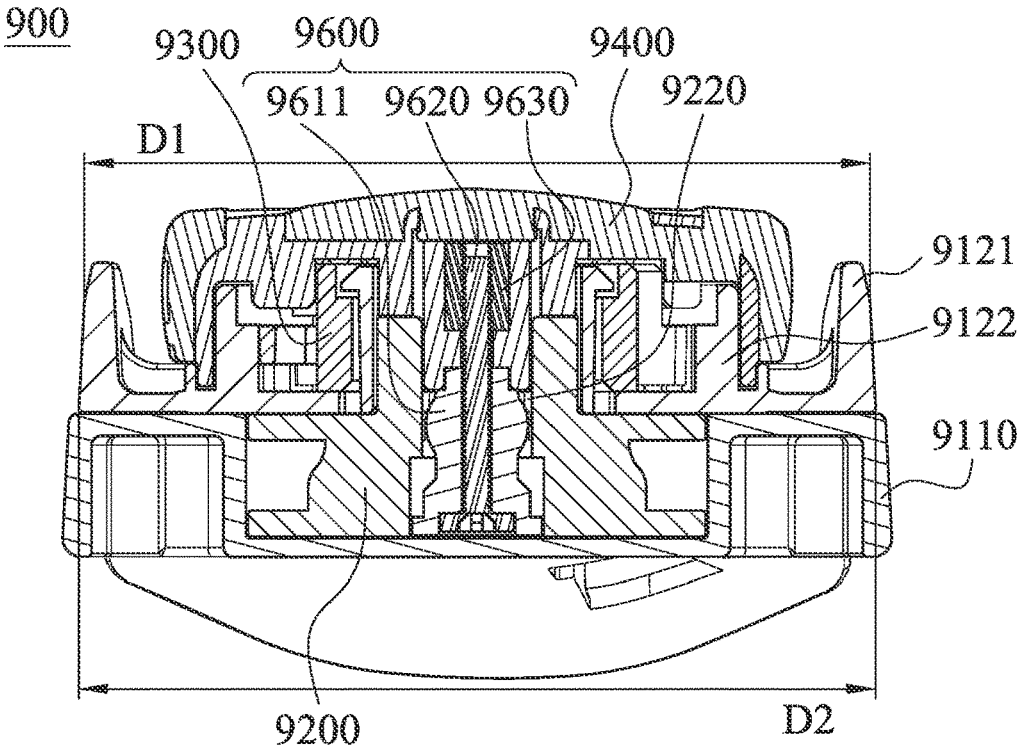
FIG. 26 shows one cross-sectional schematic view of the fastening device of the 9th embodiment in FIG. 23.
Figure 27:
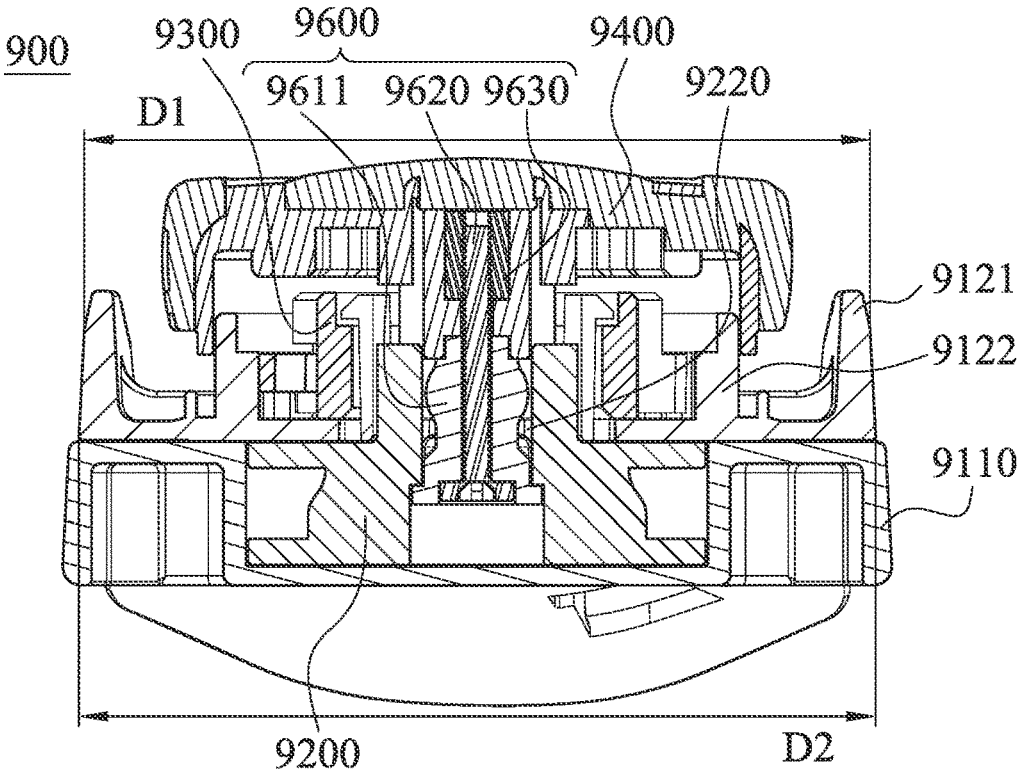
FIG. 27 shows another cross-sectional schematic view of the fastening device of the 9th embodiment in FIG. 23.

FIG. 26 shows one cross-sectional schematic view of the fastening device 900 of the 9th embodiment in FIG. 23. FIG. 27 shows another cross-sectional schematic view of the fastening device 900 of the 9th embodiment in FIG. 23. A distance D1 between two first radial outer-most edges of the protecting wings 9121 is equal to or smaller than a distance D2 between two second radial outer-most edges of the of the protecting wings 9121. Moreover, the protecting wings 9121 are higher than a lower edge of the knob 9400, and can protect the knob 9400.

As shown in FIG. 26, the knob 9400 is located at a lower position, the knob 9400 can be rotated in a tensioning direction A1 to allow the pawl arms 9310 to disengage from the engaging teeth, and the driving boss 9460 of the knob 9400 drives the driving hole 9210 of the spool 9200 to rotate the spool 9200 for tensioning the lace. As the knob 9400 stops, the pawl arms 9310 are engaged with the engaging teeth, and the lace is secured.

As shown in FIG. 27, as the knob 9400 is pulled upward to a higher position, a positioning protrusion 9611 of the positioning post 9610 moves from a lower side of the flexible coupling portion 9220 to an upper side of the flexible coupling portion 9220, and the knob teeth 9450 are disengaged from the driving teeth 9340. Therefore, the pawl arms 9310 cannot prohibit the spool 9200 from rotating, and the lace is released.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A fastening device, comprising:

a case, comprising:

an upper case body comprising at least one protecting wing extending upward; and a base detachably coupled to the upper case body, thereby being detachably coupled to the at least one protecting wing;

a spool disposed within the case;

an engaging unit disposed above the spool; and a knob covering the upper case body;

wherein at least a portion of the at least one protecting wing is higher than a lower edge of the knob.

2. The fastening device of claim 1, wherein the upper case body further comprises:

an inner annular member; and an outer annular member surrounding the inner annular member;

wherein the at least one protecting wing is connected to one side of the outer annular member.

3. The fastening device of claim 2, wherein the outer annular member comprises at least one mounting flange, the at least one mounting flange is disposed at the base, and the at least one protecting wing extends upward from the at least one mounting flange.

4. The fastening device of claim 2, wherein the inner annular member comprises at least one engaging projection for engaging with the outer annular member.

5. The fastening device of claim 2, wherein the outer annular member comprises two combining portions detachably connected to each other, a number of the at least one protecting wing is two, and each of the protecting wings is connected to each of the combining portions.

6. The fastening device of claim 5, wherein the outer annular member comprises at least one tab, the at least one tab extends inward from a bottom of at least one of the combining portions, and the at least one tab is coupled to the inner annular member or the base.

7. The fastening device of claim 1, wherein a number of the at least one protecting wing is two, each of the protecting wings has a top portion and a bottom portion, each of the top portions has a first radial outer-most edge, each of the bottom portions has a second radial outer-most edge, and a distance between the two first radial outer-most edges is equal to or smaller than a distance between the two second radial outer-most edges.

8. The fastening device of claim 1, wherein the upper case body further comprises an upper opening, and each of the at least one protecting wing is higher than the upper opening.

* * * * *